US010967242B2

(12) United States Patent
Ramirez

(10) Patent No.: US 10,967,242 B2
(45) **Date of Patent: *Apr. 6, 2021**

(54) SPORT GLOVES

(71) Applicant: John Ramirez, Redlands, CA (US)

(72) Inventor: John C. Ramirez, Redlands, CA (US)

( * ) Notice: Subject to any disclaimer, the term of this patent is extended or adjusted under 35 U.S.C. 154(b) by 227 days.

This patent is subject to a terminal disclaimer.

(21) Appl. No.: 16/045,695

(22) Filed: Jul. 25, 2018

(65) Prior Publication Data

US 2018/0326292 A1 Nov. 15, 2018

Related U.S. Application Data

(63) Continuation-in-part of application No. 15/012,215, filed on Feb. 1, 2016, now Pat. No. 10,137,354, which is a continuation of application No. 13/923,099, filed on Jun. 20, 2013, now Pat. No. 9,248,364.

(51) Int. Cl.
*A63B 71/14* (2006.01)
*A41D 19/015* (2006.01)

(52) U.S. Cl.
CPC ..... *A63B 71/146* (2013.01); *A41D 19/01547* (2013.01)

(58) Field of Classification Search
CPC ..... A63B 71/146; A41D 19/01547
See application file for complete search history.

(56) References Cited

U.S. PATENT DOCUMENTS 1,358,823 A * 11/1920 Burden ..... A41D 19/015 2/163
1,358,824 A * 11/1920 Burden ..... A41D 19/015 2/163
4,131,952 A * 1/1979 Brenning, Jr. ..... A41D 19/015 2/124
4,164,043 A * 8/1979 Fujita ..... A41D 19/01523 2/161.1
4,408,358 A * 10/1983 Swan ..... A41D 19/0055 2/161.1
5,184,353 A * 2/1993 Goldwitz ..... A63B 71/146 2/160
5,228,142 A * 7/1993 Yoswein-McGreen ..... A61F 13/10 2/159
5,390,372 A * 2/1995 Hashimoto ..... A41D 19/001 2/161.2
5,664,260 A * 9/1997 Weiser ..... A41D 19/02 2/159
6,055,669 A * 5/2000 Albert ..... A63B 71/148 2/161.1
6,154,885 A * 12/2000 Kobayashi ..... A63B 71/146 2/161.2
6,279,166 B1 * 8/2001 Schild ..... A41D 19/00 2/160

(Continued)

*Primary Examiner* — Khaled Annis

(57) ABSTRACT

A glove for enhancing a wearer's grip and control of a golf club or sports device. The glove may include a palmar portion and a dorsal portion having multiple digital segments that entirely enclose a wearer's thumb, ring finger and pinkie finger. The glove further includes a forefinger digital segment that exposes at least the middle and distal phalanges including the fingertips. The forefinger digital segment covers at least a portion of the wearer's proximal phalanx. The glove also has a strap means to secure the glove onto the wearer's hand.

7 Claims, 10 Drawing Sheets

(56) References Cited

U.S. PATENT DOCUMENTS

| | | | | |
|---|---|---|---|---|
| 6,427,248 | B1 * | 8/2002 | Albert | A41D 19/01558 2/161.1 |
| 6,539,551 | B1 * | 4/2003 | Jones, Jr. | A63B 69/3608 2/159 |
| 6,553,575 | B1 * | 4/2003 | Davenport | A63B 71/146 2/161.2 |
| 6,651,255 | B1 * | 11/2003 | Schild | A41D 19/015 2/160 |
| 6,725,465 | B2 * | 4/2004 | Taylor | A63B 71/146 2/161.1 |
| 8,458,817 | B1 * | 6/2013 | Babb | A41D 19/0013 2/159 |
| 2003/0208833 | A1 * | 11/2003 | Gold | A41D 19/02 2/161.1 |
| 2004/0025224 | A1 * | 2/2004 | Albert | A41D 19/01558 2/159 |
| 2008/0276348 | A1 * | 11/2008 | England | A63B 71/146 2/161.2 |
| 2013/0061369 | A1 * | 3/2013 | Lim | A63B 71/146 2/161.2 |
| 2013/0191961 | A1 * | 8/2013 | Litke | A63B 71/146 2/161.2 |
| 2013/0281234 | A1 * | 10/2013 | Ramirez | A41D 27/28 473/415 |
| 2014/0026281 | A1 * | 1/2014 | Kleinert | A41D 19/01582 2/20 |

* cited by examiner

The interlocking grip (RELATED ART)

SPORT GLOVES

This application is a Continuation-In-Part to application Ser. No. 15/012,215, which is a Continuation to application Ser. No. 13/923,099.

FIELD OF THE INVENTION

The present invention relates to sports apparatus and equipment, and uses thereof, used in playing the game of various sports. The present invention and its glove embodiments enhance the overall performance in athletic tasks and/or execution commonly associated during sports play, particularly in, but not limited to golf by configuring to meet the specific requirements of a golfer's weak hand, for example. The present invention unique finger configurations generally completely cover the thumb as well as the middle, ring and pinkie fingers of a user's hand, including the fingertips. Furthermore, the present invention is configured to leave uncovered at least the entire distal phalanx of a user's forefinger. Additionally, some embodiments may offer grip enhancers on the palm area, the thumb segment and/or on any existing finger segments, and/or provide an aperture along the middle finger digital segment.

BACKGROUND OF THE INVENTION

An important goal in playing sports is to win. Often that means proper play execution, good ball control, good grip and feel, and proper form in the sports fundamentals. Gloves and other types of hand covers are permitted in most sports. Many individuals use gloves to enhance, in some way, their competitive edge. Indeed, gloves have become so important that different types of gloves have been created for different sports. Even within a sport, different types of gloves have been invented to, among other things, maximize performance in specific tasks.

The use of gloves can increase performance especially when the user needs to grip an object like a ball or golf club, for example. Although generally useful, using prior art conventional gloves in some sports can come with significant drawbacks, especially if a user must use their hands to feel in addition to simply grip an object.

In Golf for example, a golfer grabs a golf club with both hands, and must use his or her hands to grip as well as 'feel' the golf club throughout the golf swing.

This ability to feel is critical when swinging a golf club. Once a golfer begins a golf swing, the golfer cannot not lose sight of the golf ball until impact occurs with the golf ball. Consequently, the golfer must use tactile sensations on the hands to feel if the golf club is on the correct swing plane throughout the golf swing. Once the golf swing begins, the golfer can no longer look at the golf club and must continue to look at the golf ball.

This need to feel the golf club with a hand has therefore resulted in golfers having to make a difficult choice. Although clearly these players would benefit from added grip enhancers on their hand to increase their control and accuracy, prior art gloves force a golfer to choose between all feel and no feel.

Playing the sport of golf without the help of gloves, however, can also be an inferior choice. Quite often a golfer's success requires swinging the golf club to produce significant club speed, especially when teeing off at the beginning of each hole. As the velocity of the golf club increases, it becomes increasingly more difficult to maintain a tight grip on the club; this is especially true at the point of impact with the golf ball. Virtually all active golfers have chosen therefore to enhance grip capabilities and therefore sacrifice the ability to better feel the golf club.

Consequently, in the field of Golf, to be sure, there exists much prior art in the form of gloves for a golfer's weak (non-dominant) hand. In fact, most active golf players wear a glove on their weak hand, and go without a glove for their strong hand (if one were to go to any major store to buy golf gloves, they would be sold and packaged as a single—one glove—not sold in pairs).

More specifically, the current solution to this insoluble problem has been for virtually all golfers to use one and only one glove. This glove is always placed on the weak hand, leaving the strong hand without a glove.

Golfers have generally decided to wear a glove on their weak-hand, thereby increasing the overall grip of the weak hand but, because prior art weak-hand golf gloves are full fingered and therefore cover all of the user's fingers, the weak hand loses significant tactile capabilities. Cognizant of this major deficiency, most golfers will not wear a glove on their dominant hand, presumably to compensate for the loss of tactile sensation from wearing a glove on their weak-hand.

Although this method of gripping a golf club, by wearing only one golf glove, does provide some tactile sensation, the tactile sensation is limited to only the dominant hand so that the weak hand loses significant tactile sensations. This limitation of only allowing skin contact by the dominant hand has often resulted in several problems such as: difficulty in weak-hand and dominant hand coordination because skin contact between hands is blocked by the glove; difficulty in assessing proper golf club positioning by the weak-hand throughout the golf swing; and difficulty in getting proper feedback from weak-hand sensations if one completes an improper golf swing.

It is no surprise that golfers often have difficulty landing a golf ball on the fairway, even at the highest performance levels, and currently remains an insoluble problem in the sport for amateurs and professionals alike.

There is, therefore, a long-standing need to invent a device—and improve prior art—that could offer some 'feel' ability on the weak hand, without significantly diminishing that enhanced grip ability that gloves offer. The result would of course significantly improve the current challenging method of swinging a golf club and increase overall hand control of a golfer's club swing, and greater success in competition.

One very popular golf club grip, for example, is called the interlocking grip. When you use this grip, the forefinger of the golfer's weak-hand is placed over and wrapped around the strong (dominant) hand's pinkie finger. With this grip, clearly the role of the interlocked fingers has less to do with grip and more to do with coordination and feel between the user's two hands to more effectively control the golf swing and to provide greater overall golf swing consistency. There is, therefore, no real need to cover all of the weak hand's forefinger, which touches the dominant hand's interlocked pinkie finger, and uncovering at least part if not all of the forefinger would actually significantly increase overall coordination by allowing the now uncovered portion of the weak hand's forefinger to touch the skin of the dominant hand's pinkie finger. Embodiments of the present invention would therefore offer significant improvements to prior art by offering a glove which leaves at least the fingertips of the forefinger uncovered thereby offering heightened tactile sensations on the weak hand of a user.

The present invention will provide a glove for the weak hand whereby the user may both better grip a golf club as well as maintain enhanced tactile sensitivities on parts of the otherwise gloved hand.

There are other configuration challenges in prior art golf gloves that hinder those desiring to have a proper, consistent golf swing using a conventional golf grip.

Most conventional golf gloves, for example, have ventilation recesses along the dorsal portion of the digital segments including on the forefinger which of course can be counterproductive and problematic especially when gripping a golf club using the interlocking grip. Conventional golf gloves provide recesses on the proximal phalanx of the forefinger which of course channel perspiration to this area, albeit small amounts. This is problematic because the strong hand's pinkie finger interlocks and resides over the forefinger's proximal phalanx. Intentionally trying to channel moisture to this interlocked area will clearly cause unnecessary slipping between the two interlocked fingers and further hinder the user's ability to perform a unison, coordinated golf swing.

On the other hand, without any recesses on the forefinger segment, moisture will inevitably build up within the forefinger segment, making it very uncomfortable for the user; if, however, the distal phalanx of the forefinger is uncovered, for example, any moisture buildup in the forefinger segment will naturally flow out from the uncovered portion and away from the critical interlocked or overlayed portion.

For the same reasons, recesses along the middle finger's proximal phalanx may be counterproductive as well.

Solving these unrecognized problems, as embodiments of the present invention provides, will go a long way to significantly enhance consistent golf swing control, especially during hotter weather conditions. Some embodiments include a forefinger segment without any moisture management recesses along the proximal phalanx on the forefinger segment and/or along portions of the middle finger segment, where the strong hand's pinkie finger usually rests on the weak hand.

Providing a more strategic moisture management system will create a firmer contact between the fingers of both hands, and therefore a more controlled golf swing.

There is also a long existing need for a device that could offer better hand coordination between a golfer's strong hand and weak hand without significantly diminishing a golfer's ability to adequately grip the golf club. Golfers often have to fight completing a 'slice.' When a golfer hits a slice, the golf ball flies to far outside (far right for a right-handed golfer or far left for a left-handed golfer).

A slice can take place for several reasons. One reason has to do with the dominant hand not moving at the same rate and angle as the weak hand during a golf swing, or not unhinging at the same time. If there is even the slightest separation between the two hands during the golf swing, the club face will not be square at impact; the resulting open face impact will inevitably result in a slice. An ideal location to help determine if there is even slight hand separation resides where the weak hand's middle finger touches the strong hand's pinkie finger. If the golfer is using prior art golf gloves, however, it is extremely difficult to feel if there is any hand separation throughout the golf swing because of the weak hand's middle finger loss of significant tactile sensations by being completely covered by the glove.

Inventing a solution to this problem could, among other things, allow for greater golf swing control and consistency by providing a golfer with significantly enhanced and immediate feedback with a golf swing, and thus create an entirely new market to support a golfer's dominant (strong) hand and weak hand coordination.

Some glove embodiments of the present invention offer an aperture along the weak hand's middle finger such that the skin of the weak hand's middle finger can touch the skin of the strong-hand's pinkie finger, thereby providing immediate and accurate feedback if there was any separation between the user's hands throughout the golf swing and make the proper adjustments. Among the results would be improving ball contact, trajectory and accuracy by minimizing hand separation throughout the golf swing.

The weak hand's middle finger requires a unique blend of grip and sensitivity capabilities. Providing added grip capabilities along the middle finger would allow a user to better maintain control; providing an aperture along the dorsal segment's proximal phalanx of the middle finger would simultaneously allow the user to maintain tactile sensitivities whereby at least a portion of the middle finger's skin would touch the weak hand.

Consequently, there are clear indications that an entirely new market exists for a device that could support a golfer's hand coordination, especially but not limited to those who play golf using the interlocking grip. In particular, there remains an unmet need that would provide multiple benefits, such as better overall grip and more coordination with both hands during the practice or play of golf, and in various other sports activities. The present invention solves the above mentioned problems by, among other things, providing a glove configured for use on the weak hand that can increase grip abilities on areas primarily responsible for the gripping a golf club, while allowing portions of the other fingers to be uncovered and able to maintain necessary feeling capabilities.

DETAIL DESCRIPTIONS OF THE INVENTION

The present invention provides a glove having dorsal (back) and palmar (front) portions for overlaying respective back and palm regions of a human hand, said dorsal and palmar portions having distal and proximal ends with a plurality of digital segments (or stalls) projecting from said distal ends. The digital segment of the thumb covers the entire thumb including the fingertip of said thumb of a user, the digital segment of the middle finger generally covers the entire middle finger including the fingertip of said middle finger of a user, the digital segment of the ring finger covers the entire ring finger including the fingertips of said ring finger of a user, and the digital segment of the pinkie finger covers the entire pinkie finger including the fingertip of said pinkie finger of a user when the glove is worn. The glove palmar portion covers the palm of the hand including all five the user's metacarpophalangeal joints of the user's hand; the glove dorsal portion covers the back of the hand. The glove also has a wrist portion that covers the wrist of a user.

Additionally, at the Entire Distal Phalanx of a User's Forefinger Will be Uncovered.

In one preferred aspect, a forefinger digital segment exists whereby only the forefinger's distal phalanx is uncovered, in its entirety, therefore a forefinger segment will exist on the embodiment that covers a user's proximal and middle phalanges, in their entirety.

In another embodiment, a user's forefinger is completely uncovered, therefore no forefinger segment will exist in the embodiment. In this case, the glove will comprises a glove with a body comprising a palmar portion, a dorsal portion and a distal lateral edge, wherein the palmar portion and the dorsal portion meet at the distal lateral edge. The glove will further comprise a terminal edge at the distal lateral edge of the body designed to allow a forefinger to extend past the terminal edge to completely expose the forefinger when the glove is worn, thereby providing a glove without a digital segment for a forefinger.

Preferably, at least a portion of the forefinger's proximal phalanx is covered creating a distal terminal edge along the glove forefinger segment, therefore a forefinger segment will exist that covers at least a portion of a user's proximal phalanx and leaves uncovered at least a portion of the distal phalanx of said forefinger such that the fingertips would be exposed to have heightened tactile sensitivities.

Accordingly, embodiments provide a novel glove that takes into account a user's preferred golf grip, such as the interlocking grip, for example, by allowing the interlocked forefinger to be better able to feel the dominant hand while allowing other fingers of the gloved hand to maintain heightened grip capabilities.

In another preferred aspect, the terminal edge whereby the forefinger extends past and is thereby exposed, is further sealed. When cutting certain materials such as synthetic materials including synthetic leather it is virtually impossible to keep the edges from fraying and splitting, or from allowing atmospheric moisture to enter into the material through the formed edges, thereby eroding and destroying the glove material. Therefore it is essential that the entire terminal edge be permanently sealed, preferably by hot knife sealing. The industrial hot knife is preferably used to melt the fabric edges of the terminal edge such that the terminal edge is entirely sealed thereby preventing fraying, fabric splitting, and atmospheric moisture from entering into the glove body material through the terminal edges. If any portion of the terminal edge is not sealed, in other words if there are portions along the terminal edge which are not completely sealed, these portions along the terminal edge will fray or split eroding the integrity of the glove structure and its valuable and unique benefits to the user. Hot knife sealing will also create a smooth finish along the entire terminal edge. Hot knife sealing can only be performed on certain materials such as synthetic leathers and plastics otherwise the material will burn and cause harm to the glove structure. Cotton material for example will burn and therefore hot knife sealing cannot be performed on that type of material. It is therefore important that at least the forefinger digital segment distal terminal edge—the area sealed—and preferably a significant portion of the glove be formed of an appropriate material, such as a synthetic material. Natural materials such as cotton and genuine leather will not hot knife seal well, burning the material and often destroying the glove. It is therefore very important that at least the terminal edge be formed of an appropriate material.

In another preferred aspect, the present invention also comprises a grip enhancing means, such as PVC dots for example, on a portion or portions of the palmar surface area of the glove. Such as for example, on any thumb and finger stalls where a finger segment exists, along any portion of any metacarpophalangeal joints, and/or between the thumb and forefinger area, generally defined by the metacarpal of the forefinger and extending up along the metacarpal of the thumb, and therebetween. The grip enhancing means is adapted to provide a higher coefficient of friction than the material forming the glove palmar portion.

The grip enhancing means is therefore specifically positioned to provide enhanced grip and a higher coefficient of friction along select areas of the palmar portion of the glove. The grip enhancing means will offer a golfer multiple benefits such as increased control of a ball or device thereby enhancing performance and overall success at performing a sports task.

In at least one embodiment all of the above mentioned areas will comprise of a grip enhancing means including all five metacarpal areas of the user's hand when the glove is worn. For example, an embodiment can comprise of a grip enhancing means overlaying the entire metacarpophalangeal joints of the pinkie finger, ring finger, middle finger and forefinger when the glove is worn. The grip enhancing means is therefore be defined by overlaying the four finger digital creases and extending down about three centimeters (width), enough to cover the entire metacarpophalangeal joints of said fingers in their entirety. The length would be defined by the two opposing sides of the palm, say about seven to ten centimeters in general. This area would then include, for example, a high friction surface or a textured surface, as the grip enhancing means thereby providing a higher coefficient of friction than the surrounding untextured palmar portion. The grip enhancing means could be comprised of a beaded surface pattern, for example, projecting out at least ½ millimeter, and which could be integral to the glove material, preferably extending throughout the entire designated surface area, but could certainly be provided on at least one centimeter by one centimeter along the designated outer surface to provide added grip support, such as, for example, only on the metacarpophalangeal joint of the forefinger (provided a forefinger segment exists on the particular embodiment). Enhancing the user's grip along the metacarpophalangeal joints is particularly important when playing the sport or golf or football, where much of the grip requirements exist and are needed. As aforementioned for example the shaft of a golf club is supported by the metacarpophalangeal joints of the user's hand (see FIG. 10).

In at least one embodiment, the entire palmar surface comprises a grip enhancing means throughout the glove palmar portion.

In general, the grip enhancing means of the present invention may be integral to the glove or may be affixed to the glove surface by, for example, forming a grip enhancing panel and applying the panel onto a portion of the glove. The grip enhancing means of an embodiment could comprise, for example, a high friction textured surface with a more narrow width, say about 1.5 to three centimeters. This and other embodiments may include a plurality of projections or a plurality of depressions on the surface as the gripping means which is formed from, for example, one of a vinyl material, a rubber material, or a neoprene material, creating a grip enhancing panel.

The material forming the grip enhancing panel could then be applied to one or more finger stalls using any standard bonding methods, such as adhesion or stitching. The projections can preferably be provided, for example, on at least one—or only on one—phalanx of any finger stalls. The projections could preferably extend out less than 1/10 of a centimeter, but could range generally from 1/20 of a centimeter to several centimeters.

In general, the grip enhancing panel may preferably be formed from an elastic material or fabric, including but not limited to, a knitted fabric, for example, lycra, rayon, neoprene, a rubber material, a vinyl material, or the like. Once the grip enhancing surface on the panel has been formed, the grip enhancing panel may then be applied to the palmar surface of the glove by any standard methods, such as by stitches or adhesives, for example.

In general, the grip enhancing means of the present invention creates a significantly higher coefficient of friction than the surrounding material forming the palmar portion of the glove, and can be comprised of various grip-enhancing materials, forms, coatings, and designs, including but not limited to, foams, fabrics, PVC dots, perimeter patching designs, linear and non-linear grooves, or combinations thereof, high friction surfaces, textured surfaces, a plurality of regular or irregular projections, a plurality of regular or irregular depressions, non-slip materials and coatings, such as PVC coatings, nitrile coatings and latex coatings, and designs creating coarse surfaces such as eighty grit Emory cloth for example, as well as pebbled or beaded surfaces, convex or concave bumps, striations, cross-hatches, convex or concave linear and non-linear lines, angled ribs, random structures, convex or concave ridges, crevices, elongated segments, and the like. Preferably, the depths of the depressions and/or heights of projections would be such that the gap formed by the depressions or projections would allow for some movement of the palmar surfaces thereby increasing the grip capabilities of the user. The height or depth ranges can generally begin at about 100 micrometers to several millimeters or more.

The grip enhancing means may further comprise a plurality of spaced apart stripes or striped projections formed from a high friction material, such as a PVC material, for example. Preferably the stripes comprise raised or projecting stripes and are arranged to extend generally parallel to the axis of any existing finger stalls. Stripes and other forms may be uniformly spaced or spaced at varying intervals. Similarly, stripes and other forms may have varying thicknesses, heights or depths, depending on preference. The thickness ranges generally can begin at about 100 micrometers to several millimeters or more. The grip enhancing means may create a pattern, may be in rows or randomly placed, and may form non-circular and circular shapes, such as spherical, cylindrical or elongated. Additionally, they may be individually separated or interconnected.

In general, the palmar surface of an embodiment can have a variety of finishes, one portion of the surface can have a smooth finish, for example, and another portion can have a textured surface. The textured portion creates a higher coefficient of friction, or grip enhancer, on the palmar surface of the glove.

The grip enhancing means can be formed on the glove by any standard method, for example, by embossing, stamping or molding a portion of the glove to create the gripping means. For example, the grip enhancing means can comprise of regular projections of say, about 300 micrometers in height, but may vary in height depending on preference. The projections may all be the same height, and may be in rows. They may be embossed elongated shapes that are interconnected, thus creating a high coefficient of friction throughout the entire palmar surface area of the glove. Other embodiments could of course offer different heights, non-uniform Oheights, and have a more random pattern on the palmar portions forming the glove.

The grip enhancing means preferably provides an effective coefficient of friction, preferably of a Shore A Durometer of about 2.0 or greater; more preferably between a coefficient of friction of between 1.5 and 3.5.

Accordingly, embodiments provide a novel glove with added grip-enhancing features that substantially enhance overall control and sports performance.

Embodiments may also offer a liner or sleeve which may be integrally formed on the glove. For example, the liner (or sleeve) could be attached to the glove by standard methods, such as by conventional stitching about the perimeter of the dorsal segment.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing or practicing in colder conditions (or when playing at night, which is beginning to gain in popularity).

It will be apparent to one of ordinary skill in the art that many other implementations of liners are possible.

In yet another aspect, embodiments may also comprise an aperture along the middle finger digital segment of the glove. The aperture will generally leave uncovered at least a portion of the middle finger segment's proximal phalanx. The aperture resides along the proximal phalanx, thereby defining its general boundaries. Within this parameter the location of the aperture (e.g., only on the side of the proximal phalanx or primarily of the top dorsal portion) along the middle finger segment will vary due to user preference and sport being played.

Accordingly, embodiments can also provide a novel glove with features that assist a golfer significantly improve hand coordination by allowing the skin of the weak hand's middle finger to touch the skin of the strong hand's pinkie finger and thereby increase hand coordination throughout a golf swing. Among the benefits of this unique configuration include heightened critical tactile sensitivities to more properly feel if there is any separation between the weak hand's middle finger and the dominant hand's pinkie finger, throughout the golf swing.

Embodiments also have an expandable opening means at a wrist end adapted to receive the user's hand. The expandable opening means comprises an elastic material along the wrist portion, such as an elastomeric band fixed around the wrist.

The present invention also comprises of a strap means. The glove dorsal portion further comprises a strap means at the open end of the glove body dorsal portion for fastening the glove body secure about the wrist area, critical in sports activities where the user's hand moves very rapidly such as in golf or football. The strap means may have two pads of cohesive-adhesive material for releasably securing the strap. The strap as well as this wrist portion may be sewn onto the glove, for example. The strap means also comprises a flap which mechanically engages a flap capture mechanism to secure the glove to the users hand (e.g., a synthetic hook and loop fastening interface which adheres when pressed together, commonly using VELCRO). In this case the flap could overlay a small slit or opening along a portion of the back of the hand to allow the glove to widen when a user places the glove on to the hand. The slit allows the user to quickly take off or put on the glove, and doing so very easily. The combined features of providing a slit with a strap means is especially valuable to users who play a sport that requires the constant removal of the glove, such as in football—where players generally take off their gloves during a change of possession, and in golf—where virtually all players take off their glove when preparing to putt a golf ball.

Embodiments may also comprise of micro-recesses along any portions of the glove, generally used on golf gloves and baseball gloves for ventilation or moisture management purposes. These micro recesses are generally about 0.120 millimeters or so in diameter. These micro recesses are generally not along the proximal phalanx of the middle finger segment or the proximal phalanx of the forefinger, although some embodiments may be configured as such to meet user conventional preferences. Alternatively or additionally, recesses may reside on the glove portion overlaying one or more metacarpophalangeal joints. In at least one embodiment, an aperture will reside on a metacarpophalangeal joint segment, such as along the middle finger metacarpophalangeal joint, to provide added ventilation and added flexibility. The aperture on the metacarpophalangeal joint portions will preferably not extend beyond said joint portions, thereby defining their terminal edges.

Embodiments may further comprise a detachable golf ball marker to more easily allow a golfer to mark the spot of the golf ball's location. The detachable ball marker is secured by any standard fastening means, such as by snap fastening, by a VELCRO fastening compartment, by magnetism, or the like.

The finger segments of embodiments are preferably designed to fit snugly around a user's fingers, as are typical sports gloves. In addition, some embodiments may have material treated by a moisture repellant, for example SCOTCH GUARD or a synthetic resin, extremely useful during harsher weather conditions. Additionally, embodiments may also comprise various weather-resistant and perspirant-resistant materials, forms and designs including, but not limited to, water-resistant materials or micro-recess designs along any portion of the glove, for moisture management, or combinations thereof.

Embodiments may be made and manufactured using standard materials and methods in developing sports gloves. Materials that can comprise these glove embodiments include, but are not limited to, woven materials such as natural, synthetic or blends of natural and synthetic yarns, thermoextruded or thermoset rubbery embodiments such as those made from thermoplastic elastomers. Examples of synthetic yarns include nylon, polyester, and spandex (polyurethane) yarns. Embodiments may also comprise stretch materials and designs, mesh fabrics, recycled and flexible materials, cottons, polyester, rayon, spandex, fleece, leathers and synthetic leathers, rubbers, plastics, woven fabrics, non-woven fabrics, cloths, LYCRA, a vinyl material, a neoprene material, a fleece material, or combinations thereof. With this in mind, material selection should consider embodiment necessities. For example, some embodiments offer elasticity along the dorsal portion of the glove that overlays the user's metacarpophalangeal joints, therefore a stretch material would be a more appropriate selection. Sealing requirements would also need to be considered in material selection.

The thickness of the dorsal and palmar segments can generally begin anywhere from 0.002 inches to 0.040 inches or more as are standard sports gloves, for example, and can depend on several factors such as comfort and durability preferences. Some embodiments may offer more durable material for the dorsal surface thus requiring an even thicker dorsal segment.

Construction of the present invention may be accomplished by any standard methods, such as, for example, by designing the dorsal and palm sections to meet along a conjoining lateral edge to define a pocket for receiving the eminence of a user's hand. Other standard methods of construction could certainly be used, of course.

Furthermore, the glove terminal edge or the forefinger segment distal terminal edge is also reinforced by stitching. Stitching the forefinger stall along or around the opening is very important because the opening would otherwise easily tear, destroying the finger segment and therefore the glove, making the glove inoperable. Reinforcing the edge is particularly important because of intended sport activity use such as Golf where users are constantly engaging and disengaging the glove during sports play. This constant movement of the user's hand increases stress on the integrity of the glove by the continual rubbing and twisting of the edge when engaging and disengaging the glove. Therefore the stitching is adapted to encircle the entire terminal edge or distal terminal edge in order to be effective at preventing tearing along the terminal edge or distal terminal edge.

One sport that will clearly benefit from the present invention is Golf. The present invention will meet an unmet need by significantly and substantially improving prior art gloves for the weak hand. Currently, only full-fingered gloves are used by golfers. Prior art therefore does not allow a golfer to take complete advantage of his/her preferred grip by allowing for skin contact between both hands and thereby maximizing hand coordination throughout the golf swing.

One embodiment that would improve prior art comprises a glove that covers essentially all of the weak-hand's thumb, middle, ring and pinkie fingers, while leaving the user's forefinger completely uncovered.

Using embodiments of the present invention now allow a user playing Golf, for example, to place their covered thumb, middle finger, ring finger and pinkie finger on the golf club, and increase the grip by the glove embodiment, while being able to maintain maximum tactile abilities by leaving uncovered the user's weak hand forefinger. This and other embodiments now allow far greater feel and coordination lost with prior art especially when gripping a golf club using the conventional interlocking grip. The interlocked fingers now allow for far better feedback because both interlocked fingers are now uncovered, making it easier to adjust a golf swing. Users who prefer this embodiment will greatly benefit from maximum feel between the completely uncovered interlocked fingers of both hands.

This and other features now essentially make the sports glove more operable, novel and significantly superior to prior art, especially for those playing the sport of Golf using the popular interlocking grip.

Additionally, a grip enhancing means may be provided along the palmar surface of the glove to further increase grip capabilities, if preferred. For example the grip enhancing means may comprise a plurality of projections formed from a skid resistant material, such as neoprene, PVC, rubber or the like. The projections can form a pattern on the palmar surface. Preferably, the high friction surface includes interstices or spaces between projections to allow for necessary flexibility. Preferably, the projections have an average height of about 700 micrometers or more.

Another preferred glove embodiment that will provide superior advantages over prior art in the sport of Golf would only partially cover the user's forefinger while essentially enclosing the thumb, middle, ring and pinkie fingers.

As previously mentioned, one very popular grip is called the interlocking grip. When you use this grip, the forefinger of the golfer's weak-hand is placed over his dominant hand and is interlocked with the dominant hand's pinkie finger. With this grip, clearly the role of the weak-hand's forefinger has less to do with grip and more with coordination and feel on the strong-hand, to more effectively control the golf swing and to provide greater golf swing consistency. There is, therefore, no real need to cover all of the weak-hand's forefinger, and covering the forefinger actually diminishes said forefinger's sensitivities. Embodiments of the present invention would offer significant improvements to prior art.

This embodiment could comprise a glove that covers essentially all of the weak-hands thumb, middle, ring and pinkie fingers, while leaving the forefinger's fingertips uncovered. Specifically, for example, a forefinger digital segment would exist whereby all of the proximal and middle phalanges are completely covered. In addition, most of the distal phalanx would be uncovered, say about sixty percent, such that all of the forefinger's fingernail is completely uncovered, and extending around the palmar portion of the forefinger segment.

Users who prefer this embodiment will greatly benefit from significantly increased feel between the uncovered portions of the interlocked fingers of both hands, while still providing some grip-enhancing support along the forefinger's proximal phalanx, where the forefinger segment often touches the golf club during a golf swing.

A grip enhancing means can of course be formed on this and other embodiments. For example, a grip enhancing means can also be formed on any finger stalls or along the metacarpophalangeal joints if preferred, thus providing added grip capabilities along the area where the club is gripped. For the same reasons aforementioned, this embodiment would significantly assist golfers using any of the interlocking, for example. The grip enhancing means may comprise of stripes, for example, projecting out about 600 micrometers.

Among the benefits of the present invention include: the ability to offer greater golf consistency and accuracy by solving this previously unsolvable problem in prior art; a far more successfully coordinated golf swing; and heightened feel capabilities for better feedback if the golf club inappropriately moves during a golf swing. Using this embodiment will allow a user to maximize feel with both hands.

This embodiment may also comprise of a wrist end with a strap means to secure the glove to the user's hand. The strap means may comprise a strap or a flap which mechanically engages a flap capture mechanism (e.g., a synthetic hook and loop fastening interface which adheres when pressed together, commonly using VELCRO).

An expandable opening means may also be employed such as, for example, an elastic means such as an elastomeric band fixed around then wrist aperture. Embodiments may also have combinations of both a flap capture mechanism and an elastomeric band. The wrist portion may be formed integral with the glove or may be attached to the glove by standard methods, such as by sewing.

This and other embodiments may be in the form of a standard synthetic leather golf glove, with the dorsal and palmar surface areas essentially covering all five metacarpals, with the exception of a slit along the dorsal surface which allows the golfer to insert the hand into the glove quickly, necessary in active sports play such as golf and football, and micro recesses along portions of the glove to allow for ventilation.

Embodiments may also offer an additional significant feature to greatly enhance golf swing performance and hand swing coordination. One modification to the embodiment just mentioned above, may, in addition to having heightened tactile sensitivities along the weak hand's forefinger, may also offer increased tactile sensitivities along the weak hand's middle finger. This heightened tactile sensitivity may be accomplished by having an aperture along the weak hand's middle finger digital segment. The aperture on the middle finger segment is preferably located to leave uncovered a portion of the proximal phalanx, thus creating one rather large aperture. This finger configuration will allow a golfer to increase their overall control of a golf swing.

When the golfer uses the interlocking grip and places the Pinkie finger of his/her dominant hand around and between the uncovered Forefinger and covered Middle finger of his weak-hand, the coordination from the added feel between the two hands will be enhanced with this embodiment. As the strong hand's pinkie finger wraps around and embraces the covered weak hand's covered forefinger's proximal phalanx, the pinkie finger would abut and also touch the skin of the weak hand's middle finger because of the embodiment's aperture along the middle finger segment.

This embodiment, and others, can allow a golfer to use the interlocking method to provide the usual grip capabilities on the weak hand while now providing significantly superior tactile sensations in coordinating hand movements because of the aperture. By providing this opening along this select area, the user can uniquely increase feel without losing grip capabilities along other portions of the interlocked hands.

The increased sensitivities will provide a user with significantly enhanced capabilities to coordinate a golf swing, to feel if there is even a modest amount of unnecessary movement between both hands, and to more properly adjust his or her next golf swing. Embodiments of the present invention offer these significant improvements thereby solving an unrecognized problem in prior art.

Some embodiments, of course, will not have an aperture along the middle finger segment. These embodiments that are absent of any aperture will be useful and significantly beneficial to those playing the sport of golf, primarily because the unique finger configurations of the glove, as well as because of any grip enhancing means on embodiments.

Additionally, this embodiment can have a palmar and dorsal portion overlaying a portion of the wrist area. For example, the wrist portion can be stitched on the glove and be made of an expandable composition whereby the glove expands when being placed on a hand, and then naturally readjusts to fit snugly around the user's wrists.

Finally, this and other embodiments may also provide a detachable ball marker, such a circular magnetic disc that attaches to a magnet located on the dorsal surface area of the golf glove, for example. The ball marker may be secured by any standard fastening means, such as by magnetism or snap fastening, for example. The back portion of the detachable ball marker as well as the connecting dorsal segment of the glove may both therefore have small magnets. The ball marker may be circular or non-circular in design.

The rest of the hand, front and back, can be essentially covered by the glove.

Clearly, the present invention provides users significant and substantial benefits, including but not limited to significantly improved feedback capabilities, especially when it comes to feeling if a user's hands were misaligned at any time throughout a golf swing.

The benefits of these significant and substantially different physical configurations of the present invention will inevitably create a new method of gripping a golf club. The generally accepted method of swinging a golf club is clearly a result of the limitations of prior art gloves.

The present invention will, for example, allow a user's weak hand to have heightened tactile sensitivities to have a better coordinated and proper golf swing. Once a user begins to swing the golf club, the user can have heightened sensitivities to feel if the hands suddenly are misaligned, for example. The golfer should now have a more stable overall grip, better control and enhanced performance possibilities. This improved method, of gripping and swinging a golf club by having heightened tactile sensitivities on both hands, not just with the dominant hand, will provide a user with greater overall control and consistency in a golf swing.

SUMMARY

Many features can be used in conjunction with each other to uniquely solve problems that have up until now been unsolved.

In general, embodiments of the present invention can generally be used in conjunction with any type of hand task activity and/or sports play. As discussed, embodiments offer an individual with the opportunity to increase overall hand task performance. Maintaining or increasing overall control, for example, can provide many benefits to a user of these, and other embodiments. These and other embodiments:

- offer the ability to grip as well as feel a sports device, such as a golf club
- provide a unique solution for users who desire better grip capabilities only in select areas
- offer a more stabilizing overall grip of a ball or object, by conveying significantly higher grip-enhancing capabilities to select locations of the hand
- provide significantly higher grip enhancing capabilities along the connecting area between the thumb and forefinger
- allow an individual to maintain or increase control of a ball or object along the metacarpophalangeal joints
- permit the ability to use a glove on a weak hand configured to meet the unique needs of a user's preferred golf grip, especially for those using an interlocking grip
- improve performance in hand task execution by providing heightened feel capabilities on a golfer's weak hand
- offer more control capabilities throughout a sports task, a valuable feature when striking a golf club with greater velocity
- allow more hand coordination by adjusting grip-enhancers to match a preferred particular golf swing
- decrease the likelihood of golf slices
- provide superior coordination in a golf swing
- enhance overall control and golf swing stability.
- improve tactile feedback to feel if a user's wrist moved the wrong way forward or backward—during a golf swing
- increase the possibility for squarer golf clubface at impact with the golf ball thereby improving ball contact, trajectory and accuracy.
- allow a user to maintain grip capabilities that a glove generally provides while being able to significantly enhance tactile sensations along the same hand.
- provide a much improved method of playing the sport of Golf by using a grip enhancing means not just on the weak hand but also on the strong hand as well, without limiting the feel and coordination requirements in a proper golf swing.
- create a more strategically placed moisture management system that is more appropriately suited for golfers who use the interlocking or overlapping grip.
- increase a more unison golf swing by allowing the user to better feel if his or her hands separate during the unhinging process.

These are among the many benefits of the present invention, and are not to be construed as limitations of the benefits nor their legal equivalent.

Although the description of the present invention only discussed two sports, it is understood that individuals playing other sports might benefit as well, such as football.

Furthermore, only some embodiments have been discussed and in no way is intended to limit all the various embodiments and other embodiments that the present invention provides, such as but not limited to, different designs or multicolors or fluorescent colors. Embodiments can of course be used by men and women, boys and girls, professional athletes or amateurs, as well as by those whose dominant hand is the right hand or the left.

BRIEF DESCRIPTIONS OF THE DRAWING

It is expressly understood that the following descriptions and drawings are for illustration purposes only, and in no way are intended to limit the scope of the present invention and its various embodiments. For example, the drawings are of embodiments for the left hand but can easily be created for the right hand.

FIG. 1 is a drawing of the palmar (front) view of an embodiment. The glove completely covers the thumb, middle finger, ring finger and pinkie finger. The glove also has a finger segment that covers the forefinger's proximal phalanx but does not extend to cover the forefinger's middle or distal phalanges.

DETAILED DESCRIPTION OF THE DRAWINGS

It is expressly understood that the drawings are for the purpose of illustration and description only and are not intended as a definition of the limits of the invention.

Figure 1:
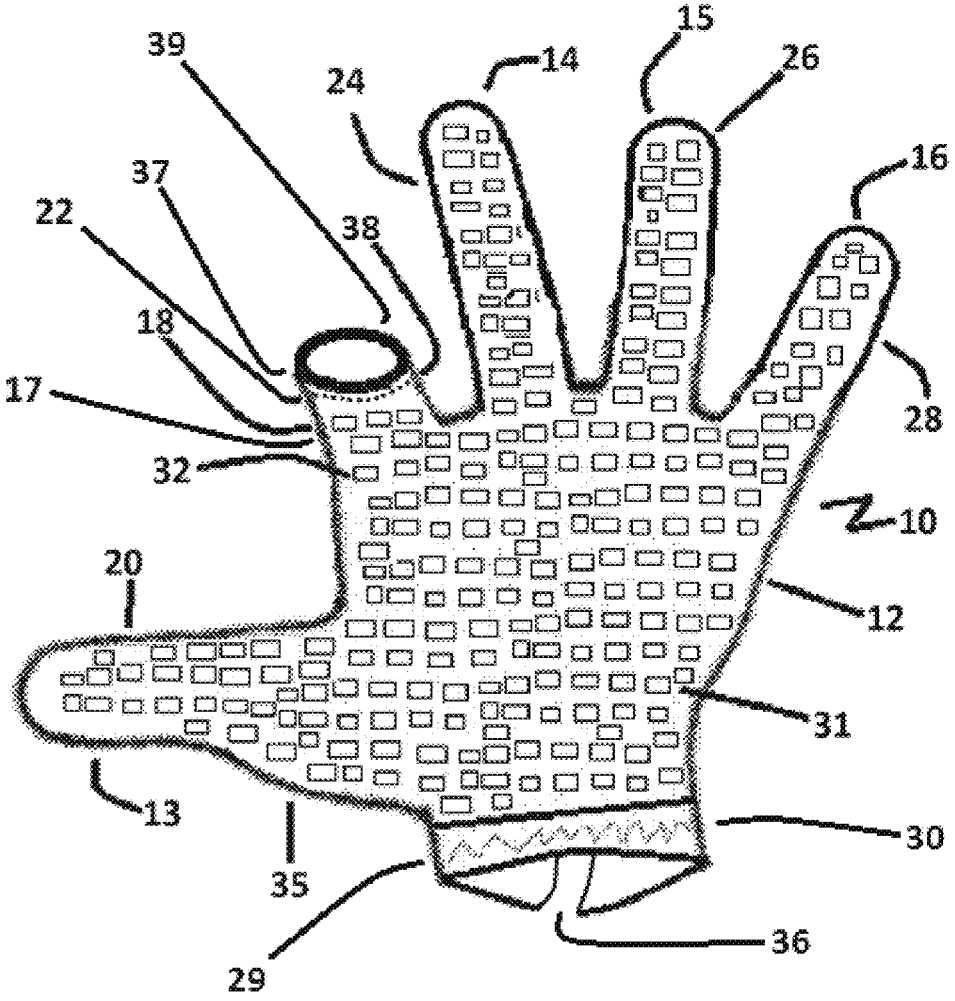
Figure 2:
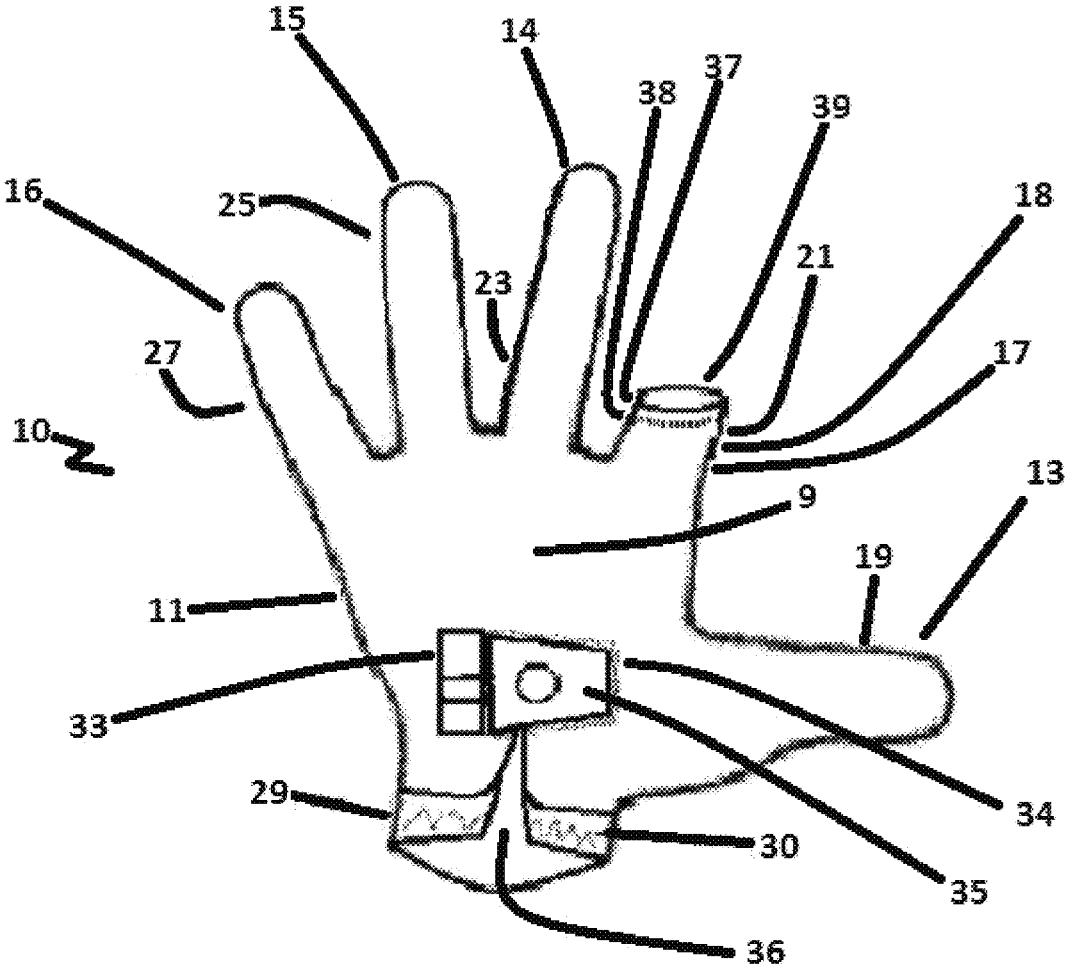
FIG. 2 is a drawing of the embodiment as described in FIG. 1, showing the dorsal (back) view.

Referring now to FIG. 1 and FIG. 2, an embodiment of the present invention is shown and designated as 10. The palmar view of a glove is drawn in FIG. 1 and the dorsal view of the same glove is drawn in FIG. 2. This partial-fingered embodiment provides a glove having a dorsal portion 11, a palmar portion 12 for overlaying respective back and palm regions of a human hand, said dorsal and palmar portions having distal and proximal ends with a plurality of digital segments (or stalls) projecting from said distal ends. The glove includes a glove body having a back portion covering the back of the hand 11, and a front portion covering the palm or front of the hand 12. The glove body includes finger stalls (or digital segments) and a thumb stall (digital segment) each adapted to receive a finger or thumb, respectively, therein.

In the illustrated embodiment the glove is constructed such that the thumb 13 digital segment encloses said thumb, including enclosing the fingertips. The glove has a middle finger digital segment 14 that encloses the middle finger, including the fingertips, a ring finger digital segment 15 that encloses the ring finger, including the fingertips, and a pinkie finger digital segment 16 that covers the pinkie finger, including the fingertips of a user. In addition, the glove has a forefinger digital segment 17 with a distal terminal edge 37. Said forefinger digital segment is adapted to extend to cover up to but not more than the proximal phalanx 18 of the user's forefinger, therefore does not extend to cover the middle phalanx nor any portion the distal phalanx of the user's forefinger when the glove is worn, therefore defining the forefinger segment. The forefinger digital segment is thereby adapted to expose a significant portion of the user's forefinger when the glove is worn, thereby allowing heightened tactile sensitivities along the fingertip and simultaneously enhancing grip capabilities along the covered proximal phalanx of the user's forefinger. Covering the proximal phalanx allows the user to maintain grip along the area where the proximal phalanx grips the golf club, while exposing the middle and distal phalanges gives the user heightened tactile sensitivities along the area where the middle and distal phalanges interlock with the opposing hand's pinkie finger, for example.

The palmar section also covers the palm segment overlaying the palm of the hand 12; the dorsal section also covers the back of the hand 11. The glove also has a wrist portion that surrounds the wrist of a user. The thumb stall 13 is defined by a dorsal portion 19 and a palmar portion 20. The forefinger stall 17 is defined by a dorsal portion 21 and a palmar portion 22. The middle finger stall 14 is defined by a dorsal portion 23 and a palmar portion 24. The ring finger stall 15 is defined by a dorsal portion 25 and a palmar portion 26. The pinkie finger stall 16 is defined by a dorsal portion 27 and a palmar portion 28.

Furthermore, the forefinger segment distal terminal edge 37 is reinforced by stitching 38. Stitching the forefinger stall along or around the opening is very important because the opening would otherwise easily tear, destroying the finger segment and therefore the glove, making the glove inoperable. Therefore the stitching 38 is adapted to encircle the entire distal terminal edge 37 in order to be effective at preventing tearing along the forefinger terminal edge 37.

The forefinger segment distal terminal edge 37 is further sealed 39. When cutting certain materials such as synthetic materials including synthetic leather 9 it is virtually impossible to keep the edges from fraying and splitting, or from allowing atmospheric moisture to enter into the material through the formed edges, thereby eroding and destroying the glove material. Therefore it is essential that the entire terminal edge 37 of the forefinger digital segment be permanently sealed 39, preferably by hot knife sealing 39. The industrial hot knife is preferably used to melt the fabric edges of the terminal edge such that the terminal edge is entirely sealed thereby preventing fraying, fabric splitting, and atmospheric moisture from entering into the glove body through the terminal edges. If any portion of the distal terminal edge is not sealed, in other words if there portions along the terminal edge which are not completely sealed, these portions along the terminal edge will fray or split eroding the integrity of the glove structure and its valuable and unique benefits to the user. Hot knife sealing will also create a smooth finish along the entire distal terminal edge allowing for easier glove application principally be allowing the user's forefinger to smoothly engaging and disengaging the partial forefinger digital segment. In other words, the glove provides a forefinger digital segment 17 that covers a portion of the proximal phalanx 18, but does not extend to cover the middle phalanx nor any portion the distal phalanx of the user's forefinger, therefore defining the forefinger segment's distal terminal edge 37. The forefinger digital segment is thereby adapted to expose a significant portion of the user's forefinger when the glove is worn. Additionally, the forefinger distal terminal edge is also sealed along the entire edge which among other critical reasons aforementioned, thereby also allowing the user's forefinger to easily slip into and out of the forefinger digital segment when engaging and disengaging the glove. Hot knife sealing can only be performed on certain materials such as synthetic leathers and plastics otherwise the material will burn and cause harm. Cotton material for example will burn and therefore hot knife sealing cannot be performed on that type of material.

The wrist portion is preferably expansible so as to hold more securely to the user's wrist. Therefore the embodiment also has an expandable opening means 29 at a wrist end 30 adapted to receive the user's hand. The expandable opening means comprises an elastic material along the wrist portion, such as an elastomeric band 29 fixed around the wrist. The wrist end 30 further comprises a strap means 33 at the open end of the glove body dorsal portion for fastening the glove body secure about the wrist area, critical in sports activities where the user's hand moves very rapidly such as in golf or football. The strap means may have two pads of cohesive-adhesive material 34, 35 for releasably securing the strap. The strap means as well as this wrist portion may be sewn onto the glove, for example. The dorsal portion of the glove further comprises a slit 36. The slit 36 allows the user to quickly take off or put on the glove, and doing so very easily. These features of providing a combined slit and strap means are especially valuable to users who play a sport that requires the constant removal of the glove, such as in football—where players often take off their gloves during a change of possession, and in golf—where virtually all players take off their glove when preparing to putt a golf ball.

This embodiment further shows how the present invention may comprise a grip enhancing means 31. Although the embodiment now provides a higher coefficient of friction on a golfer's weak hand, one may now further increase grip areas by adding a grip enhancing means on select areas or on the entire palmar surface of the glove.

In the illustrated embodiment, the grip enhancing means comprises a high friction surface 31 formed on the entire palmar surface of the glove 12, including the palmar surfaces of the thumb segment 20 and any existing finger segments 22, 24, 26 and 28. Preferably, the high friction surface is formed from a PVC material, a nitrile material, a latex material, or a rubber material (as shown) 35. The surface may include a plurality of depression or a plurality of projection pattern formed from the high friction material. Formed on the illustrated material is a plurality of square-like depressions 32 that are applied to the entire palmar surface area by any standard means, as aforementioned. These square-like depressions preferably are spaced apart to allow for added grip and flexibility. The rubber palmar surface can then be conjoined to the dorsal surface, thus creating the glove. Preferably, the depths of the embodiment's depressions are such that the gap formed by the depressions allow for some movement of the palmar surfaces thereby increasing the grip capabilities of the user. The depth can generally begin at about one hundred micrometers to several millimeters or more. For example, these depressions are about two hundred micrometers in depth on average, about two millimeters in width and four millimeters in length.

The dorsal surface may comprise of a different material than the palmar surface, such as a more durable fabric, but would preferably also be rather flexible. If the dorsal surface is comprised of more durable fabrics, such as synthetic leather, then some added elasticity capabilities may be also preferable on select areas of the dorsal surface, in particular around the metacarpophalangeal joints. For example, the dorsal surface may comprise of an aperture on the forefinger's metacarpophalangeal joint, the middle finger's metacarpophalangeal joint, the ring finger's metacarpophalangeal joint, and on the pinkie finger's metacarpophalangeal joint. Alternatively, embodiments may simply comprise of a more elastic material, such as any of those aforementioned such as spandex, on the dorsal surface overlaying said metacarpophalangeal joints, or seams or slits, while the rest of the dorsal surface is comprised of a more durable material. The elastic material could be stitched onto those areas, and therefore replacing the more durable materials along those select areas. As aforementioned however, the forefinger digital segment distal terminal edge is hot knife sealed. It is therefore important that at least the forefinger digital segment distal terminal edge and preferably a significant portion of the glove be formed of an appropriate material, such as a synthetic material. Natural materials such as cotton and genuine leather will not hot knife seal well, burning the material and often destroying the glove. It is therefore very important that at least the terminal edge be formed of a synthetic material.

The palmar and dorsal surfaces, and any wrist portions, may then be conjoined on any finger and thumb portions, dorsal and palm portions and a wrist portion using any standard methods, such as by stitching, thus defining a pocket for receiving a user's hand.

As aforementioned, this embodiment provides users with several benefits, in multiple sports. For example, those playing the sport of Golf may use this embodiment on their weak hand thereby allowing the golfer significantly more grip capabilities while simultaneously being able to have heightened tactile abilities at the same time on key areas of the interlocked—and partially uncovered—forefinger.

By way of example, baseball pitchers may also find this embodiment beneficial over their strong (pitching) hand primarily because it offers grip enhancing capabilities on the fingertips on select digital segments while allowing the pitcher to maintain heightened feel by simultaneously providing the pitcher with the ability to touch the baseball with the skin of his or her forefinger.

Figure 3:
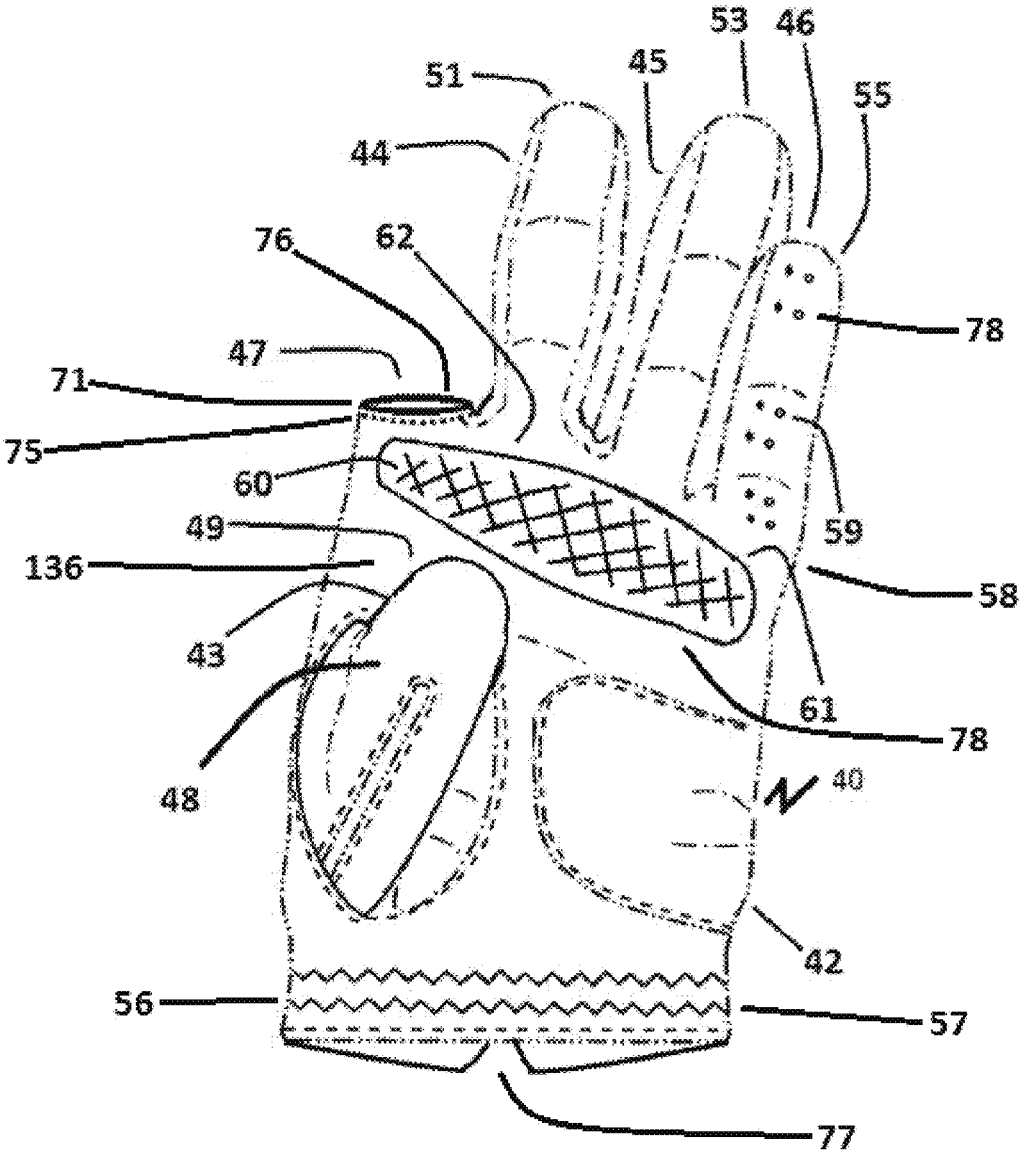
FIG. 3 is a drawing of the palmar view of a second embodiment.
Figure 4:
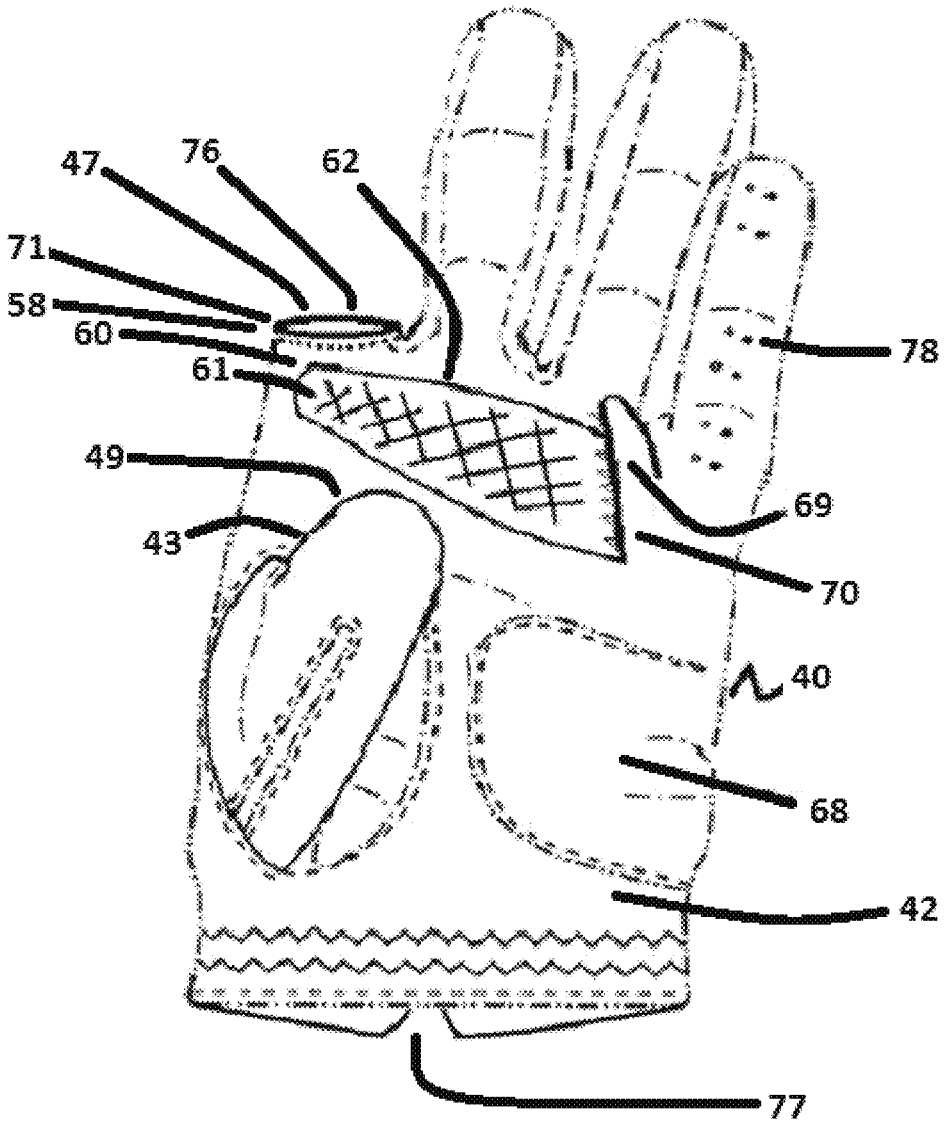
FIG. 4 shows the top and bottom view of a panel which creates a higher friction surface on an embodiment, as shown in FIG. 3.
Figure 5:
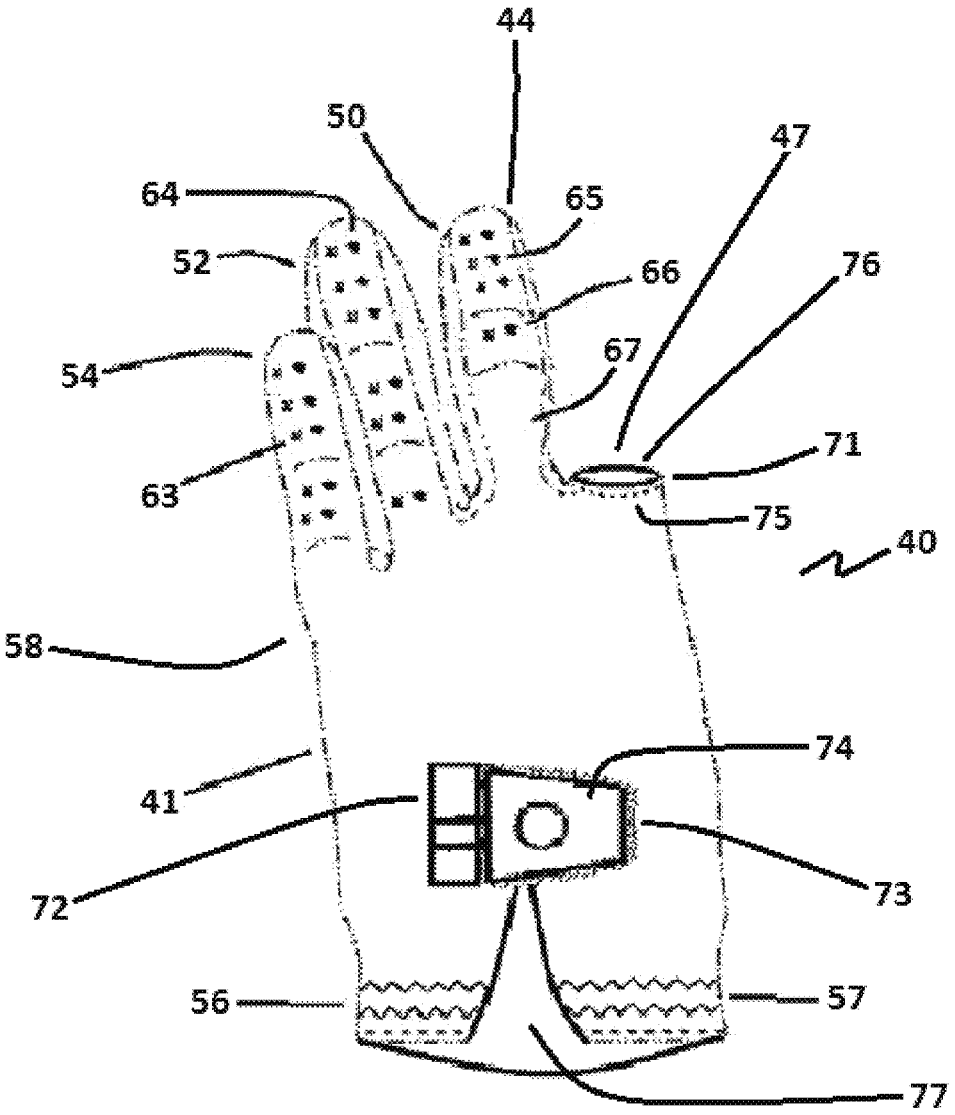
FIG. 5 is a drawing of the embodiment as described in FIG. 3, showing the dorsal view.

Referring now to FIG. 3, FIG. 4 and FIG. 5, a second embodiment of the athletic glove of the present invention is shown and designated as 40. This embodiment comprises a glove with a body comprising a palmar portion, a dorsal portion and a distal lateral edge 58, wherein the palmar portion and the dorsal portion meet at the distal lateral edge. The glove also comprises a plurality of digital segments projecting from the distal lateral edge of the body, the plurality of digital segments including a digital segment that is adapted to cover and enclose an entire thumb finger, a digital segment that is adapted to cover and enclose an entire middle finger, and a digital segment is adapted to cover and enclose an entire ring finger when the glove is worn. The glove also comprises a terminal edge 71 at the distal lateral edge of the body designed to allow a forefinger to extend past the terminal edge to completely expose the forefinger when the glove is worn, thereby providing a glove without a digital segment for a forefinger. The palmar (front) view of the glove is drawn in FIG. 3 and the dorsal (back) view of the same glove is drawn in FIG. 5. This partial-fingered embodiment provides a glove having a dorsal portion 41 and a palmar portion 42 for overlaying respective back and palm regions of a human hand, said dorsal and palmar portions having distal and proximal ends with a plurality of digital segments (or stalls) projecting from said distal ends. The glove includes a glove body having a back portion covering the dorsal surface of the hand 41, and a front portion covering essentially the entire palm surface of the hand 42. The glove body includes finger segments and a thumb segment each adapted to receive a finger or thumb, respectively, therein.

In the illustrated embodiment, the glove is constructed such that the thumb 43 digital segment encloses said thumb, including enclosing the fingertips. The glove also has a middle finger digital segment 44 that covers the middle finger, including the fingertips, a ring finger digital segment 45 that covers the ring finger, including the fingertips, and a pinkie finger digital segment 46 that covers the pinkie finger, including the fingertips of a user. This embodiment does not have a forefinger digital segment 47 therefore a user's forefinger is completely uncovered when the glove is worn. In other words, the user's forefinger, defined by the proximal phalanx, the middle phalanx and the distal phalanx of the user's forefinger, is entirely exposed when the glove is worn.

The palmar surface of this glove embodiment therefore essentially covers the rest of the front of the hand, including the entire palm of the hand 42; the dorsal section covers most of the rest of the back of the hand 41.

The thumb stall 43 is defined by a dorsal portion 48 and palmar portion 49. The middle finger stall 44 is defined by a dorsal portion 50 and a palmar portion 51. The ring finger stall 45 is defined by a dorsal portion 52 and a palmar portion 53. The pinkie finger stall 46 is defined by a dorsal portion 54 and a palmar portion 55. There is no forefinger stall so there is no dorsal or palmar portion defining the forefinger stall.

The glove also has an expandable opening means at a wrist end portion 56 adapted to receive the user's hand. The expandable opening means comprises an elastic material such as an elastomeric band 57 fixed around the wrist to expand and contract when the glove is worn.

The glove dorsal portion further comprises a strap means 72 at the open end of the glove body dorsal portion for fastening the glove body secure about the wrist area, critical in sports activities where the user's hand moves very rapidly such as in golf or football. The strap means may have two pads of cohesive-adhesive material 73, 74 for releasably securing the strap. The strap as well as this wrist portion may be sewn onto the glove, for example.

The dorsal portion of the glove further comprises a slit 77. The slit allows the user to quickly take off or put on the glove, and doing so very easily. These features of providing a slit with a strap means are especially valuable to users who play a sport that requires the constant removal of the glove, such as in football—where players generally take off their gloves during a change of possession, and in golf—where virtually all players take off their glove when preparing to putt a golf ball.

This embodiment further provides unique and critical features on and around the terminal edge 71 at the distal lateral edge of the body designed to allow a forefinger to extend past the terminal edge to completely expose the forefinger when the glove is worn. Specifically, for example, the terminal edge is reinforced by stitching 75. Sewing along or around the opening 71 by stitching is very important because the opening would otherwise easily tear, destroying the distal edge making the glove inoperable. Therefore the stitching is adapted to encircle the entire terminal edge in order to be effective at preventing tearing.

The terminal edge 71 is further sealed 76 along the entire terminal edge. When cutting certain materials such as synthetic materials including synthetic leather it is virtually impossible to keep the edges from fraying and splitting, or from allowing atmospheric moisture to enter into the material through the formed edges, thereby eroding and destroying the glove material. Therefore it is essential that the entire terminal edge 71 be permanently sealed 76, preferably by hot knife sealing 76. The industrial hot knife is preferably used to melt the fabric edges of the terminal edge such that the terminal edge is entirely sealed thereby preventing fraying, fabric splitting, and atmospheric moisture from entering into the glove body material through the terminal edges. If any portion of the terminal edge is not sealed, in other words if there are portions along the terminal edge which are not completely sealed, these portions along the terminal edge will fray or split eroding the integrity of the glove structure and its valuable and unique benefits to the user. Hot knife sealing will also create a smooth finish along the entire terminal edge. Hot knife sealing can only be performed on certain materials such as synthetic leathers and plastics otherwise the material will burn and cause harm to the glove structure. Cotton material for example will burn and therefore hot knife sealing cannot be performed on that type of material.

This embodiment further shows how the present invention may also comprise a grip enhancing means 78. Although the embodiment now provides a higher coefficient of friction on a golfer's weak hand, one may now further increase grip areas by adding a grip enhancing means on select areas.

The pinkie finger digital segment 46 of this embodiment has a grip enhancing means 78 consisting of a plurality of projections 59 in the form of PVC dots 59, on at least a portion of the palmar pinkie finger segment. The PVC dots preferably project out at least about seven hundred micrometers. The PVC dots located on the palmar section of the pinkie finger stall are throughout said stall. Similar embodiments may have a grip enhancing means also along the thumb segment, or combinations thereof, to maximize grip abilities on the fingertips of the thumb and pinkie finger. This will allow for greater golf club grip retention throughout the golf swing including during impact with the golf ball.

The grip enhancing means of the present invention may be integral to the glove or may be affixed to the glove using any standard methods. For example, this embodiment comprises grip enhancing means that is integral to the glove pinkie finger stall, using any standard method known in the art. For example, the PVC dots can be imparted by any standard methods, such as, for example, by molding. The heights of the PVC dots in this embodiment are all about the same height, and are in rows. Other embodiments could of course offer different heights, non-uniform heights, and have a more random pattern on the top surface.

The locations of the grip enhancing means may vary on several factors of course, such as personal preference and preferred degree of enhanced grip. This added grip configuration will be useful especially to golfers and baseball pitchers for reasons described herein.

The embodiment's grip enhancing means 78 can also comprise of a high friction surface, such as creating crisscross depressions 60, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint. The grip enhancing means portion overlaying the pinkie finger metacarpophalangeal joint may preferably not extend over the upper-palmar crease, however, to provide optimal flexibility, although some embodiments may extend to cover the entire pinkie joint.

The grip enhancing means 78 can also comprise of a high friction surface by applying a non-slip coating, such as a latex, a nitrile or PVC coating, along described locations of this embodiment. The coating could of course also be applied to the entire palmar portion of the glove.

This grip enhancing means may be affixed to the glove. In general, as aforementioned, a grip enhancing means may be either formed on or applied to any palmar portion, such as the palm or any thumb or any existing finger stalls, using any standard methods. The embodiment's grip enhancing means 78 can comprise of a high friction surface, such as creating crisscross grooves 60 that are depressions onto a rubber surface panel 61, for example, then attaching said panel onto a portion of the gloves palmar surface area. The panel is attached to the palmar surface of the glove by any standard methods of attachment, such as by adhesion or stitching.

The panel may be is attached to the glove area, for example, beginning at the digital creases and extending to overlay the forefinger metacarpophalangeal joint, the middle finger metacarpophalangeal joint, the ring finger metacarpophalangeal joint, and the pinkie finger metacarpophalangeal joint, 62. The panel portion overlaying the pinkie finger metacarpophalangeal preferably does not extend over the upper-palmar crease, however, to provide optimal flexibility. This form of attachment may additionally be used to affix a grip-enhancing means over the thumb stall, any existing finger stalls and/or along the area between the forefinger and thumb stalls, in part or in their entirety.

The panel may generally be comprised of any flexible material, for example, a plastic material having a top surface comprising the grip enhancing area formed by a plurality of depressions, such as, for example, ridges.

A preferred depth of the crisscross depressions would be such that the gap formed by the depressions would allow for some movement of the newly formed top surface edges thereby increasing the grip capabilities of the user. This grip enhancing means could have a preferred depth beginning about six hundred micrometers, and can be imparted by, for example, embossing or standard mechanical treatments.

Alternatively, this grip enhancing means 78 may be attached, affixed or otherwise placed to select areas 62 of the glove by standard methods and forms of attachment such as by creating a textured surface on a silicone-based layer and then hot melting said silicone surface onto the palmar portion of the glove, thus providing a high friction surface on the embodiment. The panel could also be bonded to, and become a part of the palmar portion of the glove, by any other standard method.

It will be apparent to one of ordinary skill in the art that many other implementations of creating and applying panels to sports gloves are possible.

The locations of the grip enhancing means may vary on several factors of course, such as personal preference and preferred degree of enhanced grip. Additionally, the depressed designs may vary, such as being in the form of non-linear or crisscross lines, for example. Finally, the depths may vary as well.

Figure 10:
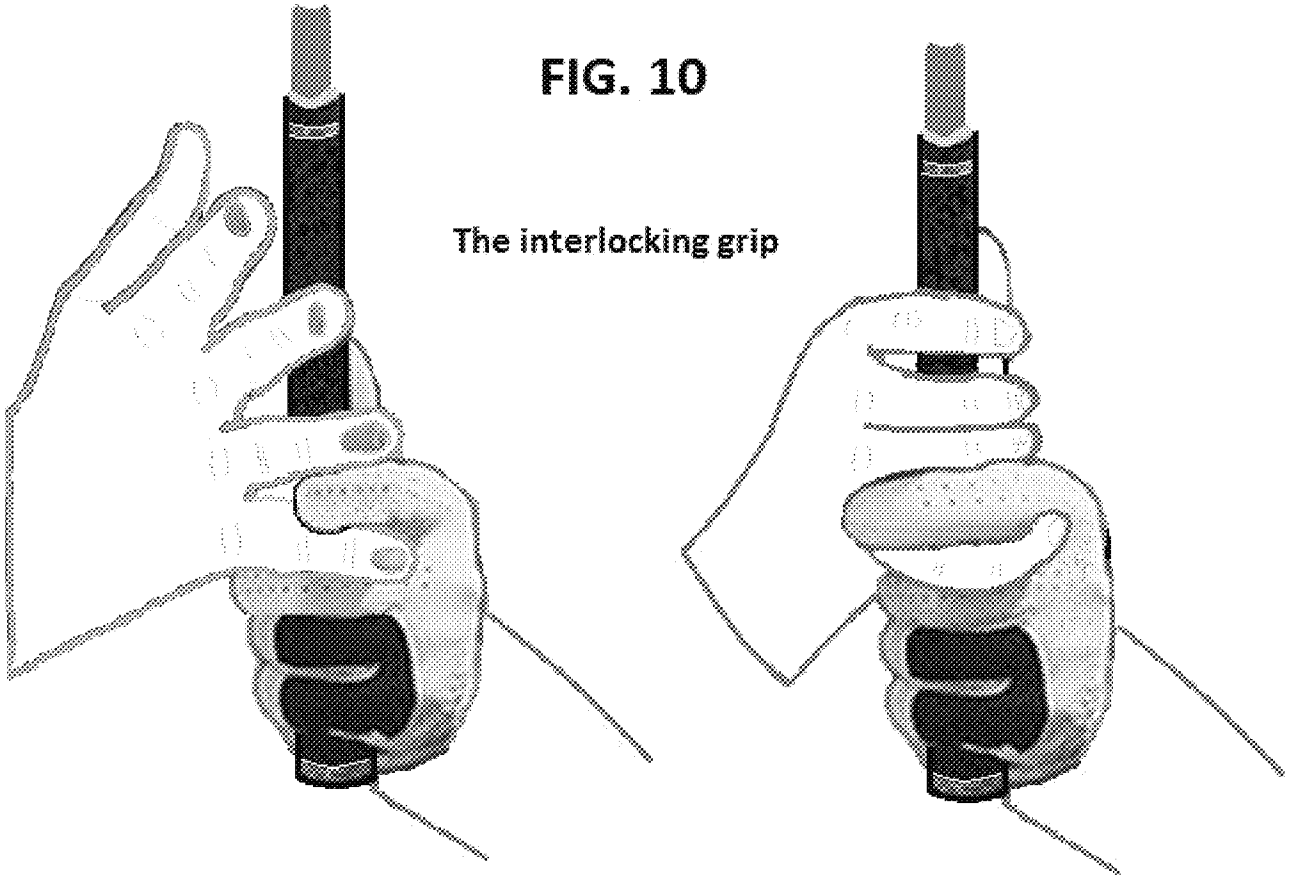
FIG. 10 shows a typical interlocking grip using a conventional prior art glove.

A plurality of micro recesses of about 0.120 millimeters in diameter may be randomly disposed about the front, back and finger and thumb stalls of the glove, thereby providing added comfort and more ventilation. The illustrated embodiment has micro recesses along and throughout the pinkie finger segment 63 and ring finger segment 64. Additionally, there are micro recesses along only the distal 65 and middle phalanges 66 of the middle finger segment. As important aspect of this embodiment is that there are no micro recesses along the proximal phalanx 67 of the middle finger. When a user of this embodiment grips a golf club using the interlocking grip, the strong hand's pinkie finger interlocks with the completely uncovered forefinger thereby providing heightened tactile sensitivities throughout the interlocked fingers. However, as can be seen in FIG. 10, the strong hand's pinkie finger also comes into contact with the weak hand's middle finger segment—specifically with the middle finger's proximal phalanx. Providing micro-recesses along the middle finger's proximal phalanx would therefore be counterproductive because the golfer needs a relatively stable contact between the middle finger and the strong hand's pinkie finger. Therefore, this embodiment would also solve an unrecognized configuration problem with prior art.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example.

This embodiment may comprise of essentially the same materials to construct both the palmar and dorsal surface. This particular glove 41, 42 can be made of a synthetic yarn and cotton blend for superior comfort, say about seventy percent synthetic. Examples of other synthetic yarns include polyester, nylon, spandex (polyurethane) yarns, LYCRA, and synthetic leather.

Additionally, embodiments such as this one, may be completely coated with a with a water repellant substance 68, such as a synthetic resin 68 on the palmar surface or throughout the entire glove.

The benefits of this configuration allows a user to have maximum retention of tactile sensation along the weak hand's forefinger, allowing the skin of said forefinger to touch not only the dominant hand's pinkie finger, but also the actual golf club, along the forefinger's uncovered proximal phalanx. The uncovered forefinger portion allows the user to maximize hand coordination, for example, crucial in completing a successful golf swing. This unique offering will significantly increase a user's ability to control a golf club and also therefore a golf swing and golf ball.

Referring now specifically to FIG. 4, what is shown is the top (front) and bottom (back) portions of a panel which creates a higher friction surface on an embodiment, as shown in FIG. 3. Specifically, shown is a panel overlaying much of the metacarpophalangeal joints of the forefinger, middle finger, ring finger, and pinkie finger stalls 62.

In general, as aforementioned, a grip enhancing means may be either formed on or applied to any palmar portion, such as the palm or any thumb or any existing finger stalls, using any standard methods.

This embodiment shows a grip enhancing means comprising of a high friction surface, such as creating crisscross grooves 60 that are depressed onto a rubber surface panel 61, for example, then attaching said panel onto a portion of the gloves palmar surface area. The bottom portion of the panel 69 is attached to the palmar surface of the glove by any standard methods of attachment, such as by an adhesive 70 or stitching.

Figure 6:
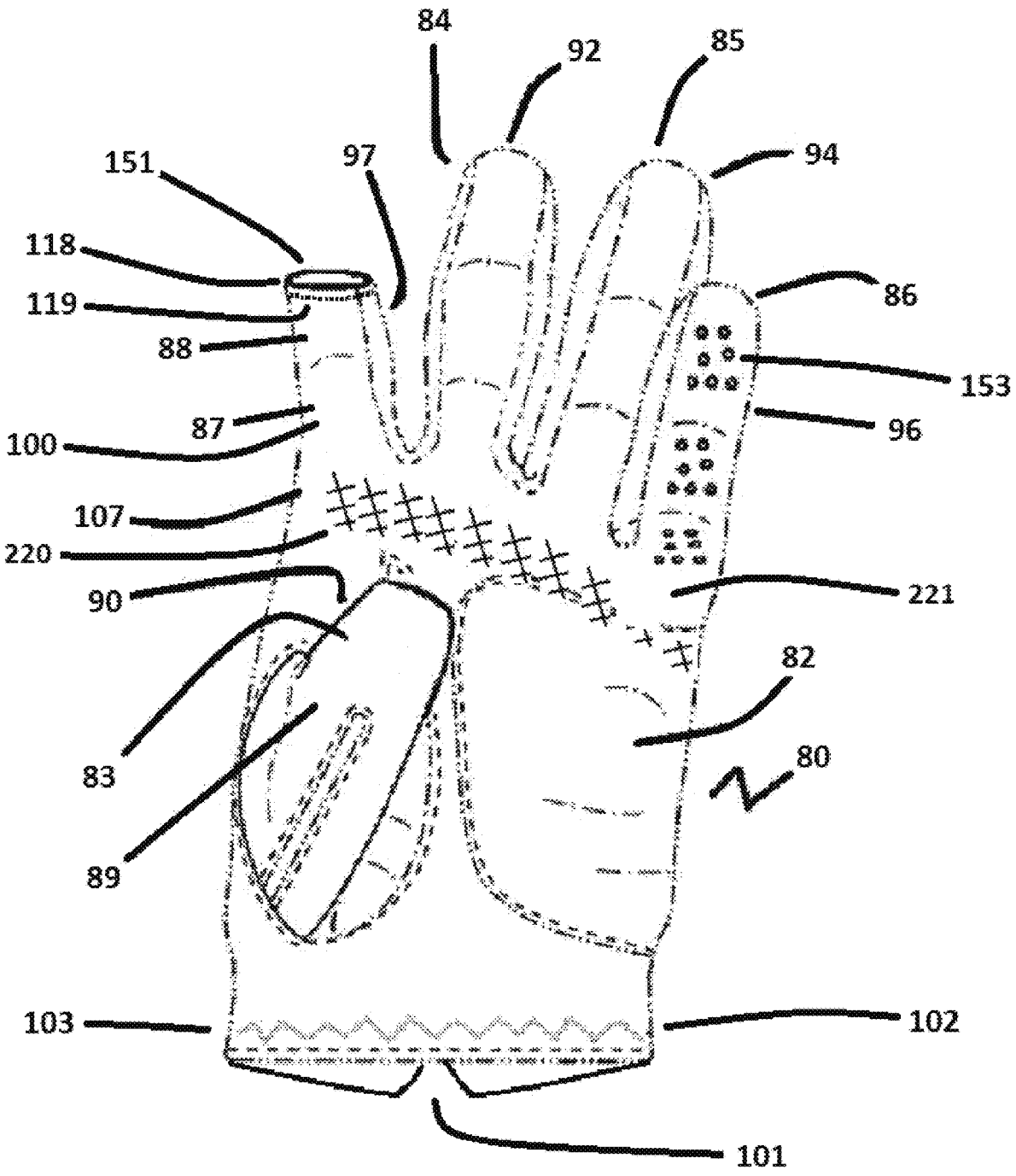
FIG. 6 is a drawing of the palmar view of a third embodiment, shown as a partial-fingered glove. The glove has a forefinger segment that covers the forefinger's proximal and middle phalanges but does not extend to cover any portion of the forefinger's distal phalanx.
Figure 7:
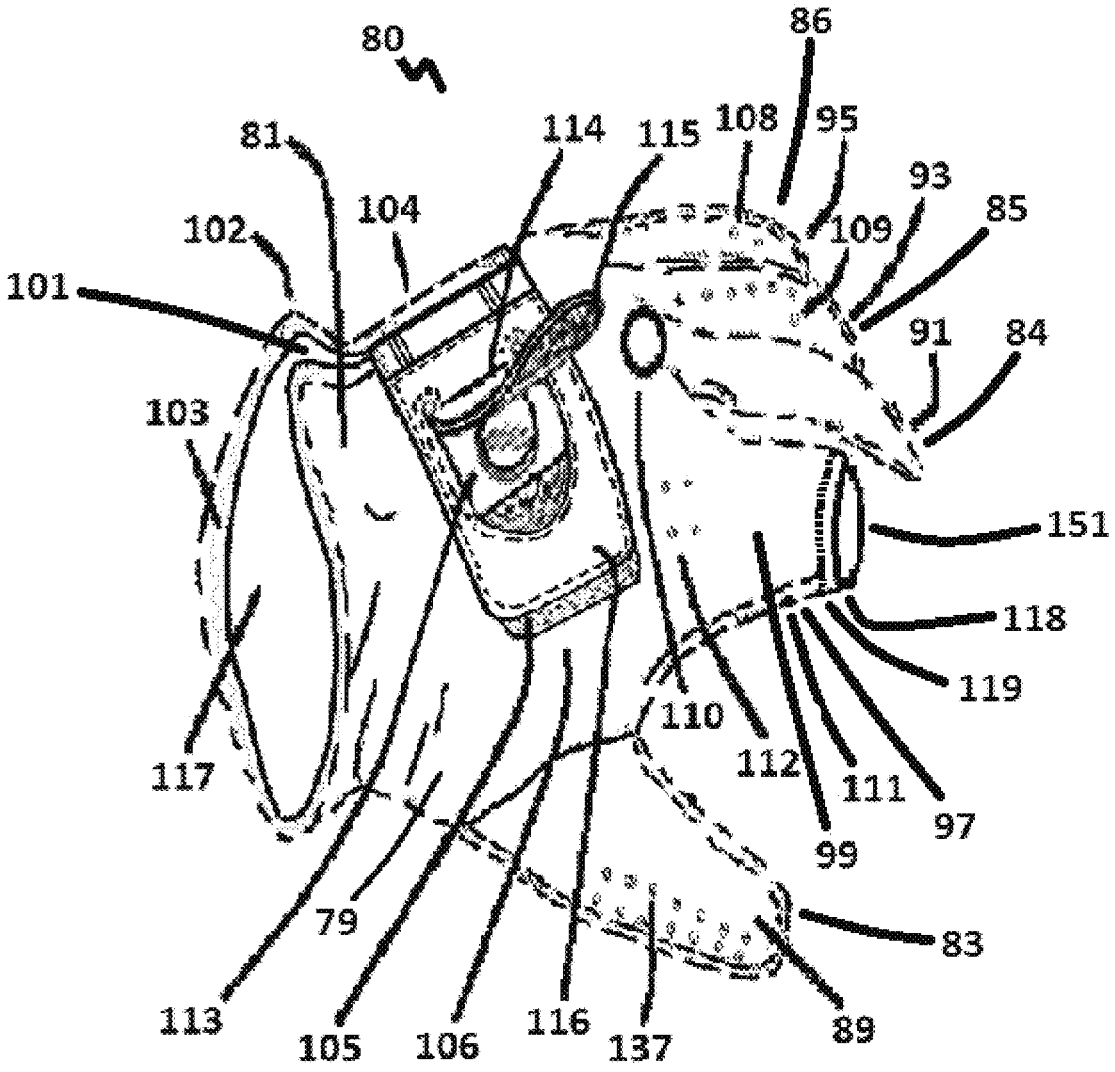
FIG. 7 is a drawing of the embodiment as described in FIG. 6, dorsal view.

Referring now to FIG. 6 and FIG. 7, an athletic glove of the present invention is shown and designated as 80. This embodiment comprises a glove with a body comprising a palmar portion, a dorsal portion and a distal lateral edge, wherein the palmar portion and the dorsal portion meet at the distal lateral edge. The glove also comprises a plurality of digital segments projecting from the distal lateral edge of the body, the plurality of digital segments including a digital segment that is adapted to cover and enclose an entire thumb finger, a digital segment that is adapted to cover and enclose an entire middle finger, a digital segment that is adapted to cover and enclose an entire ring finger, and a digital segment that is adapted to cover and enclose an entire pinkie finger when the glove is worn. The glove also comprises a partial digital segment 97 with a distal digital edge 118 that is adapted to cover the entire proximal phalanx of the user's forefinger while exposing the entire distal phalanx of the user's forefinger when the glove is worn, thereby allowing heightened tactile sensitivities along the fingertip and simultaneously enhancing grip capabilities along the covered proximal phalanx of the user's forefinger.

The palmar (front) view of a glove embodiment is drawn in FIG. 6 and the dorsal (back) view of the same glove is drawn in FIG. 7. This partial-fingered embodiment provides a glove having a dorsal portion 81, a palmar portion 82 for overlaying respective back and palm regions of a human hand, said dorsal and palmar portions having distal and proximal ends with a plurality of digital segments (or stalls) projecting from said distal ends. The glove includes a glove body having a back portion covering the back of the hand 81, and a front portion covering the palm or front of the hand 82. The glove body includes finger stalls and a thumb stall each adapted to receive a finger or thumb, respectively, therein.

In the illustrated embodiment, the glove is constructed such that the thumb segment 83, middle finger segment 84, ring finger segment 85 and pinkie digital segment 86 enclose said thumb, middle finger, ring finger, and pinkie fingers including enclosing the fingertips, respectively. The glove also has a forefinger segment that covers the forefinger's proximal 87 and middle phalanges 88 but does not extend to cover the forefinger's distal phalanx; the fingertip of the user's forefinger are therefore exposed. The palmar section covers the entire palm of the hand 82 and the dorsal section covers the back of the hand 81. The glove also has a wrist portion that surrounds the wrist of a user.

The thumb stall 83 is defined by a dorsal portion 89 and a palmar portion 90. The middle finger stall 84 is defined by a dorsal portion 91 and a palmar portion 92. The ring finger stall 85 is defined by a dorsal portion 93 and a palmar portion 94. The pinkie finger stall 86 is defined by a dorsal portion 95 and a palmar portion 96. The forefinger stall 97 is defined by a dorsal portion 99 and a palmar portion 100.

The wrist portion is expansible so as to hold more securely to the user's wrist. Therefore the embodiment also has an expandable opening means at a wrist end comprises an elastic material along the wrist portion 102, such as an elastomeric band 103 fixed around throughout the wrist portion. In addition, the glove further comprises a strap means 104 at the open end of the glove body dorsal portion for fastening the glove body secure about the wrist area, critical in sports activities where the user's hand moves very rapidly such as in golf or football.

The strap means may be unitary with the glove body and may include VELCRO fasteners 105, 106, buttons, and the like or other suitable closures thereon. The strap means allows the user to ensure a tight fit around the user's hand so that it will not disengage from the user's hand during high velocity sport movements such as swinging a driving wood golf club or throwing a Hail Mary football pass. The strap means also allows the user to quickly engage and disengage the glove, important aspects during active sports play such as in golf and in football. The wrist portion further comprises a slit 101. The slit allows the user to quickly take off or put on the glove, and doing so very easily.

Providing a slit and strap means is especially valuable to users who play a sport that requires the constant removal of the glove, such as in football—where players generally take off their gloves during a change of possession, and golf—where virtually all players take off their glove when preparing to putt a golf ball. The strap means is adapted to allow the user to mechanically stretch the strap means across the slit and fasten the glove to the user's hand.

This embodiment further provides unique and critical features on and around the distal terminal edge 118 of the partial forefinger digital segment that is adapted to expose the entire distal phalanx of the user's forefinger when the glove is worn. Specifically, for example, the distal terminal edge is reinforced by stitching 119. Stitching the forefinger stall along or around the opening is very important because the opening would otherwise easily tear, destroying the finger segment making the glove inoperable. Therefore the stitching is adapted to encircle the entire distal terminal edge of the forefinger digital segment in order to be effective at preventing tearing.

The forefinger digital segment distal terminal edge 118 is further sealed 151. When cutting certain materials such as synthetic materials including synthetic leather it is virtually impossible to keep the edges from fraying and splitting, or from allowing atmospheric moisture to enter into the material through the formed edges, thereby eroding and destroying the glove material. Therefore it is essential that the entire distal terminal edge 118 of the forefinger digital segment be permanently sealed 151, preferably by hot knife sealing 151. The industrial hot knife is preferably used to melt the fabric edges of the terminal edge such that the terminal edge is entirely sealed thereby preventing fraying, fabric splitting, and atmospheric moisture from entering into the glove body through the distal terminal edge. If any portion of the distal terminal edge is not sealed, in other words if there are portions along the distal terminal edge which are not completely sealed, these portions along the distal terminal edge will fray or split eroding the integrity of the glove structure and its valuable and unique benefits to the user. Hot knife sealing also creates a smooth finish along the entire distal terminal edge allowing for easier glove application principally be allowing the user's forefinger to smoothly engaging and disengaging the partial forefinger digital segment. Hot knife sealing can only be performed on certain materials such as synthetic leathers and plastics otherwise the material will burn and cause harm. Cotton material for example will burn and therefore hot knife sealing cannot be performed on that type of material.

This embodiment further shows how the present invention may comprise a grip enhancing means. Although the glove now provides a higher coefficient of friction on a golfer's weak hand, for example, one may now further increase grip capabilities by adding a grip enhancing means along select portions of the palmar surface of the glove.

The grip enhancing means can comprise of a high friction surface by applying a non-slip coating, such as a latex 107, a nitrile or PVC coating, along described locations of this embodiment, such as on the forefinger's metacarpophalangeal joint segment. This grip enhancing means is discreet 107 and does not extend beyond the forefinger's metacarpophalangeal joint. Those using the interlocking grip would find this grip enhanced location especially useful when trying to maintain golf club control along the forefinger's metacarpophalangeal joint, the area just below where the weak hand's forefinger interlocks with the dominant hand's pinkie finger.

The locations of the grip enhancing means may vary on several factors of course, such as personal preference and preferred degree of enhanced grip. This added grip configuration will be useful especially to those playing the sport of Golf for reasons described herein. Other grip enhancing configurations and locations may of course be preferred.

Having a gripping enhancing means along these areas will significantly increase a user's ability to control an object such as a golf club by creating an even higher coefficient of friction along the palm of the user's hand when the glove is worn.

The embodiment's grip enhancing means can also comprise of a high friction surface 220, such as creating crisscross depressions 220, to the glove area beginning at the digital creases and extending to overlay the forefinger metacarpophalangeal joint, the middle finger metacarpophalangeal joint, the ring finger metacarpophalangeal joint, and the pinkie finger metacarpophalangeal joint. The grip enhancing means portion overlaying the pinkie finger metacarpophalangeal joint preferably does not extend over the upper-palmar crease 221, however, to provide optimal flexibility. The depth of the depressions may vary, as aforementioned. These depressions are about ½ millimeter in depressions.

The pinkie finger digital segment palmar portion 96 of this embodiment has a grip enhancing means 153 consisting of a plurality of projections 153 in the form of PVC dots 153, on the palmar pinkie finger segment. The PVC dots preferably project out at least about seven hundred micrometers. The PVC dots located on the palmar section of the pinkie finger stall are throughout said stall to maximize grip abilities particularly on the pinkie finger. This will allow for greater golf club grip retention throughout the golf swing including during impact with the golf ball.

A plurality of micro recesses of about 0.120 millimeters in diameter may be randomly disposed about the front, back and finger and thumb stalls of the glove, thereby providing added comfort and more ventilation. The illustrated embodiment provides micro-recesses throughout the thumb 137 as well as the pinkie finger 108 and ring finger digital segments 109. Additionally, no micro-recesses are provided on the embodiment's middle finger segment but may be provided along said segment's middle or distal phalanx segment, if preferred. An aperture is provided along the middle finger metacarpophalangeal joint segment 110 to allow moisture to escape the middle finger segment without disturbing the interlocked finger area. Finally, no micro-recesses are provided along the forefinger digital segment or order to maintain a more moisture-free forefinger dorsal segment—where the dominant hand's pinkie finger interlocks with the weak hand's forefinger 111. Micro-recesses are provided, however, along the forefinger's metacarpophalangeal joint segment 112, which, along with the uncovered distal phalanx, will provide a more strategic moisture management system for golf glove embodiments.

The embodiment is suitably a substantially conventionally constructed golf glove, modified as aforementioned. This particular glove can be made of a synthetic material 82, 81 such as synthetic leather latex coated glove palmar 82 and dorsal portion 81 for added durability, for example. As aforementioned however, at least the forefinger digital segment should be formed of a material capable of being hot knife sealed without being burned and therefore destroying the forefinger digital segment, such as synthetic leather. It is therefore preferable that a significant portion of the glove is formed of a synthetic material such as synthetic leather or a flexible plastic. Natural materials such as cotton and genuine leather will not hot knife seal well at all and can easily destroy the glove. Examples of other synthetic yarns include polyester, nylon, spandex (polyurethane) yarns, and LYCRA.

Additionally, embodiments such as this one, may be coated with a with a water repellant substance 79, such as a synthetic resin 79 throughout the entire outer surface of the glove.

As aforementioned, the present invention, including this embodiment may be constructed using standard materials and methods of construction known in the art of making sports gloves. For example, construction of this embodiment may be accomplished by standard methods, such as, by designing the dorsal and palmar sections to meet along a conjoining lateral edge to define a pocket for receiving the eminence of a user's hand. Said dorsal and palmar sections could be conjoined by sewing, for example. One could use any standard method of manufacture and assembly or construction.

The rest of the palmar and dorsal segments could cover the rest of the hand, including the palm.

This embodiment may also comprise a detachable ball marker 113. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object with a design that points to where the golf ball exactly is located.

The detachable ball marker is secured by any standard fastening means, such as by a compartment, by magnetism or snap fastening, for example. The illustrated embodiment shows a compartment 114 within the strap on the dorsal segment of the glove. The compartment secures the ball marker by VELCRO fasteners 115, 116, but other commonly known fasteners will work just as well. The ball marker may be circular or non-circular in design.

Additionally, embodiments may offer a liner is fixed to the interior of the glove using methods known in the art, such as stitching. The liner 117 may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic 117 could also be preferred. Additionally, the liner may provide added features to offer warmth and comfort such as by comprising of a fleece material, for example, especially useful when competing in harsher conditions or during extended practices on the golf range, for example.

It will be apparent to one of ordinary skill in the art that many other implementations of liners are possible.

Figure 8:
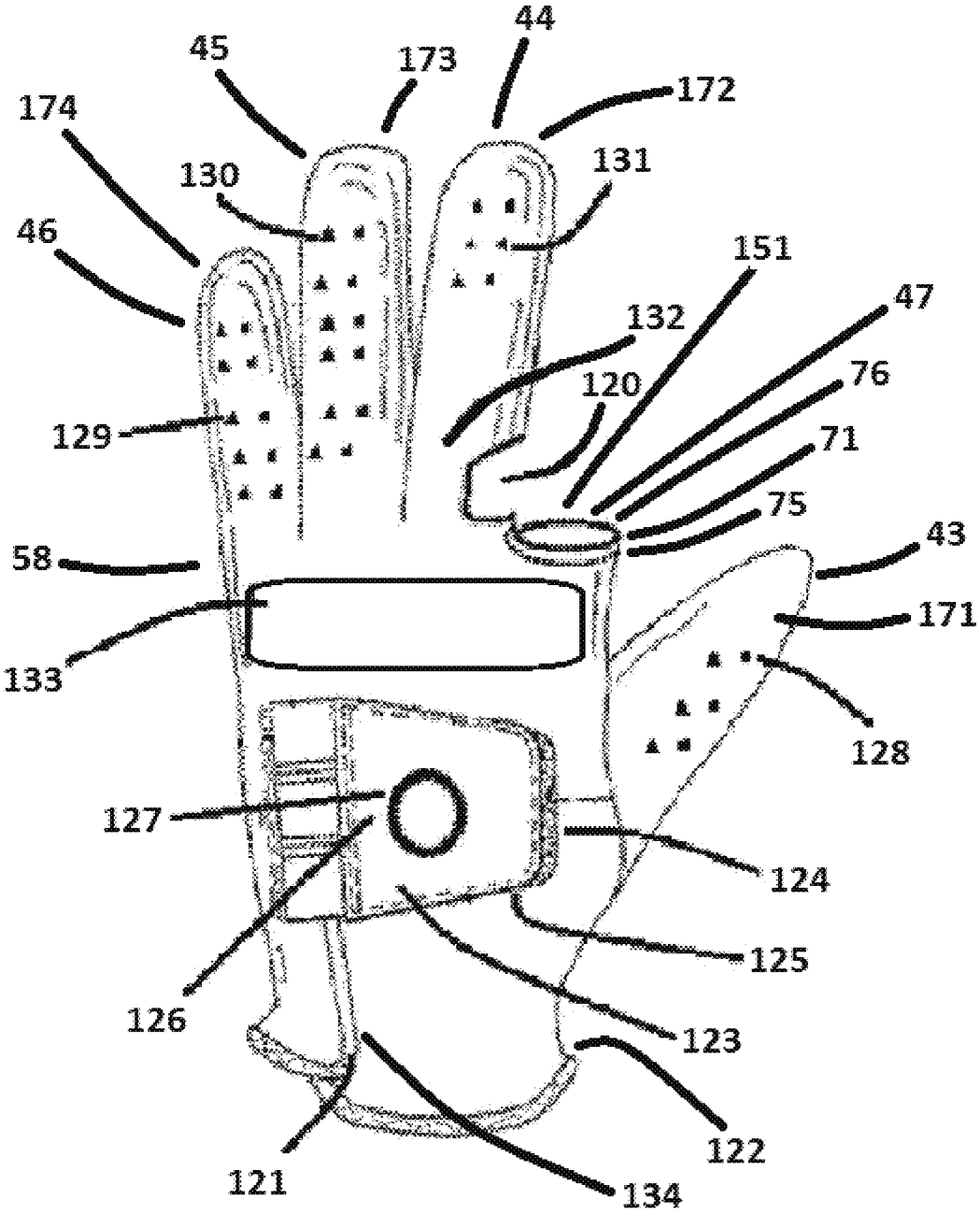
FIG. 8 is an alternative dorsal segment to FIG. 3.

FIG. 8 shows an alternative dorsal segment to FIG. 3. This embodiment comprises a glove with a body comprising a palmar portion, a dorsal portion and a distal lateral edge 58, wherein the palmar portion and the dorsal portion meet at the distal lateral edge. The glove also comprises a plurality of digital segments projecting from the distal lateral edge of the body, the plurality of digital segments including a digital segment that is adapted to cover and enclose an entire thumb finger, a digital segment that is adapted to cover and enclose an entire middle finger, and a digital segment is adapted to cover and enclose an entire ring finger when the glove is worn. The glove also comprises a terminal edge 71 at the distal lateral edge of the body designed to allow a forefinger to extend past the terminal edge to completely expose the forefinger when the glove is worn, thereby providing a glove without a digital segment for a forefinger. The palmar (front) view of the glove is drawn in FIG. 3 and the dorsal (back) view of the glove is drawn in FIG. 8.

This partial-fingered embodiment provides a glove having a dorsal portion 135 and a palmar portion 42 for overlaying respective back and palm regions of a human hand, said dorsal and palmar portions having distal and proximal ends with a plurality of digital segments (or stalls) projecting from said distal ends. The glove includes a glove body having a back portion covering the dorsal surface of the hand 135, and a front portion covering essentially the entire palm surface of the hand 42. The glove body includes finger segments and a thumb segment each adapted to receive a finger or thumb, respectively, therein.

In the illustrated embodiment, the glove is constructed such that the thumb 43 digital segment encloses said thumb, including enclosing the fingertips. The glove also has a middle finger digital segment 44 that covers the middle finger, including the fingertips, a ring finger digital segment 45 that covers the ring finger, including the fingertips, and a pinkie finger digital segment 46 that covers the pinkie finger, including the fingertips of a user. This embodiment does not have a forefinger digital segment 47 therefore a user's forefinger is completely uncovered when the glove is worn. In other words, the proximal phalanx, the middle phalanx and the distal phalanx of the user's forefinger are all entirely exposed when the glove is worn however the forefinger's palm portion, or the user's forefinger metacarpal 136, is entirely covered by the glove body when the glove is worn.

The palmar surface of this glove embodiment therefore essentially covers the rest of the front of the hand, including the entire palm of the hand 42; the dorsal section covers most of the rest of the back of the hand 135, allowing for possible micro-recesses for ventilation and the slit along the glove dorsal portion.

The thumb stall 43 is defined by a dorsal portion 171 and palmar portion 49. The middle finger stall 44 is defined by a dorsal portion 172 and a palmar portion 51. The ring finger stall 45 is defined by a dorsal portion 173 and a palmar portion 53. The pinkie finger stall 46 is defined by a dorsal portion 174 and a palmar portion 55. There is no forefinger stall so there is no dorsal or palmar portion defining the forefinger stall.

The present invention may also preferably comprise an aperture 120 along the middle finger segment, such as on any or all of middle finger's proximal phalanx. For example, this embodiment shows an aperture that resides on the middle finger's proximal phalanx, large enough such that the skin of the middle finger can touch or be touched by the pinkie finger of the dominant hand, for example, while gripping a golf club. As shown, the aperture resides primarily on the dorsal portion extending to the side of said middle finger segment.

In addition, the embodiment also has an expandable opening means 121 at a wrist end 122 adapted to receive the user's hand. The expandable opening means comprises an elastic material such as an elastomeric band 121 fixed around the wrist to expand and contract when the glove is worn. The glove dorsal portion further comprises a strap means 123 at the open end of the glove body for fastening the glove body secure about the wrist area, critical in sports activities where the user's hand moves very rapidly such as in golf or football. The strap means may be unitary with the glove body and may include VELCRO fasteners 124, 125, buttons, and the like. The strap means may have two pads of cohesive-adhesive material for releasably securing the strap, for example. The strap means as well as the wrist portion may be sewn onto the glove. The strap means allows the user to ensure a tight fit around the user's hand so that it will not disengage from the user's hand during high velocity sport movements such as swinging a driving wood golf club or throwing a Hail Mary football pass. The strap means also allows the user to quickly engage and disengage the glove, important aspects during active sports play such as in golf and in football.

The wrist portion further comprises a slit 134. The slit allows the user to quickly take off or put on the glove, and doing so very easily. Providing a slit and a strap means is especially valuable to users who play a sport that requires the constant removal of the glove, such as in football—where players generally take off their gloves during a change of possession, and in golf—where virtually all players take off their glove when preparing to putt a golf ball.

This embodiment further provides unique and critical features on and around the terminal edge 71 at the distal lateral edge of the body designed to allow a forefinger to extend past the terminal edge to completely expose the forefinger when the glove is worn. Specifically, for example, the terminal edge is reinforced by stitching 75. Stitching along or around the terminal edge opening is very important because the opening would otherwise easily tear, extending and destroying the terminal edge and therefore the glove making the glove inoperable. Therefore the stitching is adapted to encircle the entire terminal edge in order to be effective at preventing tearing.

The terminal edge 71 is further sealed 76. When cutting certain materials such as synthetic materials including synthetic leather it is virtually impossible to keep the edges from fraying and splitting, or from allowing atmospheric moisture to enter into the material through the formed edges, thereby eroding and destroying the glove material. Therefore it is essential that the terminal edge 71 be permanently sealed 76 around the entire edge 151, preferably by hot knife sealing 76. The industrial hot knife is preferably used to melt the fabric edges of the terminal edge such that the terminal edge is entirely sealed thereby preventing fraying, fabric splitting, and atmospheric moisture from entering into the glove body material through the terminal edges. If any portion of the terminal edge is not sealed, in other words if there are portions along the terminal edge which are not completely sealed, these portions will fray or split eroding the integrity of the glove structure and its valuable and unique benefits to the user. Hot knife sealing will also create a smooth finish along the entire terminal edge allowing for easier glove application principally be allowing the user's forefinger to smoothly engaging and disengaging the partial forefinger digital segment. Hot knife sealing can only be performed on certain materials such as synthetic leathers and plastics otherwise the material will burn and cause harm. Cotton material or genuine leather for example will burn and therefore hot knife sealing cannot be performed on that type of material.

This embodiment also comprises a detachable ball marker 126. A ball marker is often used when playing golf. During certain times, such as when reaching the green or when obstructing another player's direct path to the golf hole, the golfer may pick his ball and place a ball marker directly behind the golf ball; the golfer can then pick up the golf ball. The embodiment provides a convenient, detachable ball marker on the glove. The detachable ball marker in this embodiment is a small circular object 126. The detachable ball marker is secured by any standard fastening means, such as by snap fastening 127, by a VELCRO fastening compartment, or by magnetism.

The embodiment also provides micro recesses along the portion of the thumb stall 128, the ring finger segment 130 and pinkie finger segment 129, for ventilation, as is standard. However, while offering micro-recesses along the middle and distal phalanges of the middle finger segment 131 there are no micro recesses along any remaining proximal phalanx segment of the middle finger 132.

The materials forming the illustrated embodiment may comprise those discussed in reference to the present invention 135, 42. Likewise, any previously discussed methods of construction may be applied to this embodiment. This dorsal segment may be constructed as many standard golf gloves, made primarily of a durable but flexible material 135, 42, such as synthetic material 135 like synthetic leather 135, while providing a much more elastic fiber 133 such as spandex 133, along the metacarpophalangeal joints of the four fingers.

As discussed, the partially uncovered fingers as well as the aperture along the middle finger segment offer maximum retention of tactile sensation. The uncovered finger portions allow the user to maximize hand coordination, for example, while the aperture allows the user to maintain maximum feel ability on the golf club—both crucial aspects in completing a successful golf swing. This unique offering will significantly increase the golfer's ability to control a golf club and also therefore a golf swing and golf ball.

Figure 9:
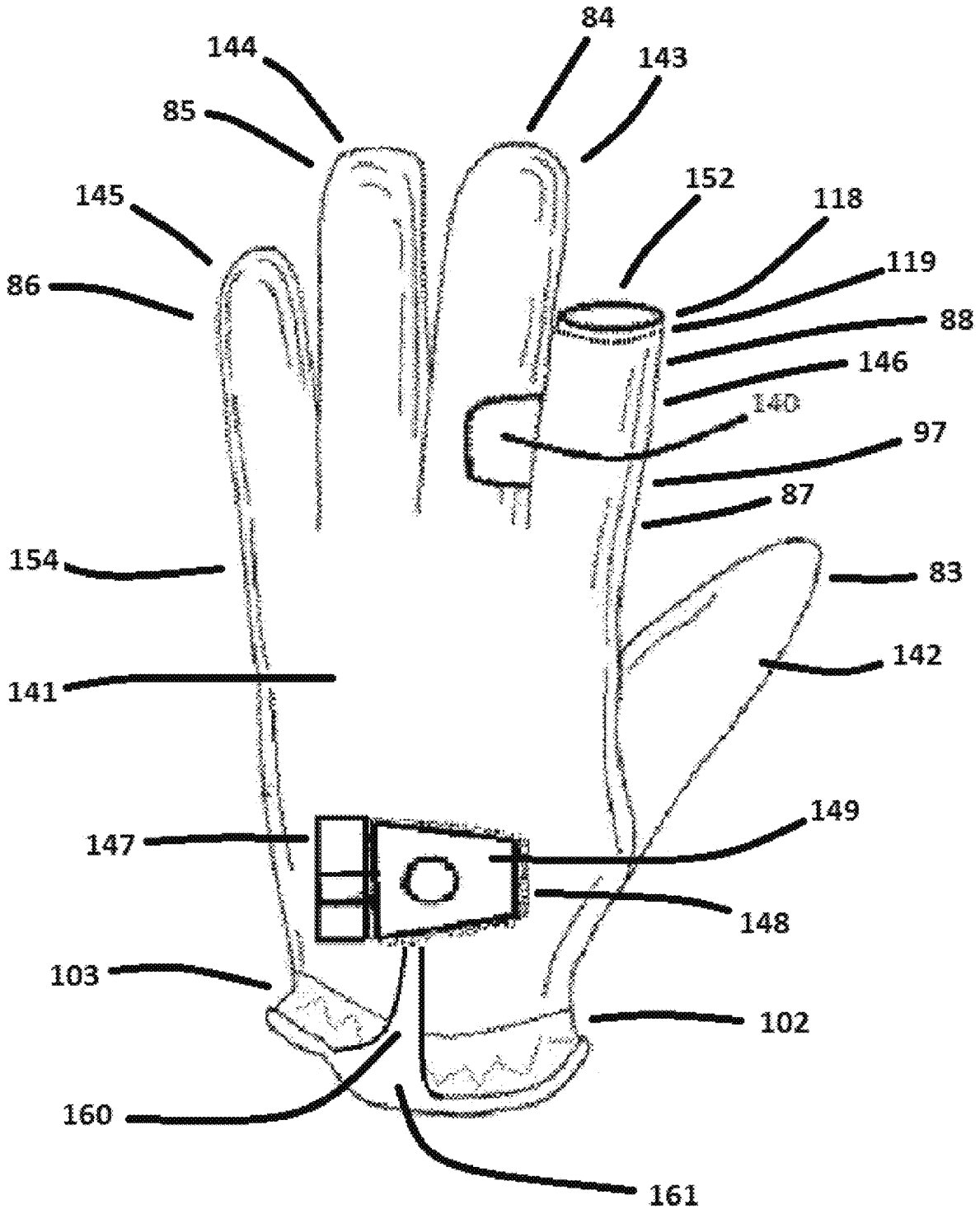
FIG. 9 is an alternative dorsal segment to FIG. 6.

FIG. 9 shows an alternative dorsal segment to FIG. 6. This embodiment comprises a glove with a body comprising a palmar portion, a dorsal portion and a 154 distal lateral edge, wherein the palmar portion and the dorsal portion meet at the distal lateral edge. The glove also comprises a plurality of digital segments projecting from the distal lateral edge of the body, the plurality of digital segments including a digital segment that is adapted to cover and enclose an entire thumb finger, a digital segment that is adapted to cover and enclose an entire middle finger, a digital segment that is adapted to cover and enclose an entire ring finger, and a digital segment that is adapted to cover and enclose an entire pinkie finger when the glove is worn.

The glove also comprises a partial digital segment 97 with a distal digital edge 118 that is adapted to cover the entire proximal phalanx of the user's forefinger while exposing the entire middle and distal phalanges of the user's forefinger when the glove is worn, thereby allowing heightened tactile sensitivities along the fingertip and simultaneously enhancing grip capabilities along the covered proximal phalanx of the user's forefinger. The palmar (front) view of the glove is drawn in FIG. 6 and the dorsal (back) view of the same glove is drawn in FIG. 9.

This partial-fingered embodiment provides a glove having a dorsal portion 141, a palmar portion 82 for overlaying respective back and palm regions of a human hand, said dorsal and palmar portions having distal and proximal ends with a plurality of digital segments (or stalls) projecting from said distal ends. The glove includes a glove body having a back portion covering the back of the hand 141, and a front portion covering the palm or front of the hand 82. The glove body includes finger stalls and a thumb stall each adapted to receive a finger or thumb, respectively, therein.

In the illustrated embodiment, the glove is constructed such that the thumb segment 83, middle finger segment 84, ring finger segment 85 and pinkie digital segment 86 enclose said thumb, middle finger, ring finger, and pinkie fingers including enclosing the fingertips, respectively. The glove also has a forefinger segment that covers the forefinger's proximal 87 and middle phalanges 88 but does not extend to cover the forefinger's distal phalanx; a user's forefinger's fingertips are therefore exposed.

The palmar section covers the entire palm of the hand 82 and the dorsal section covers the back of the hand 141. The glove also has a wrist portion that surrounds the wrist of a user.

The thumb stall 83 is defined by a dorsal portion 142 and a palmar portion 90. The middle finger stall 84 is defined by a dorsal portion 143 and a palmar portion 92. The ring finger stall 85 is defined by a dorsal portion 144 and a palmar portion 94. The pinkie finger stall 86 is defined by a dorsal portion 145 and a palmar portion 96. The forefinger stall 97 is defined by a dorsal portion 146 and a palmar portion 100. The palmar portion of the glove body cover all five palm's five metacarpals of the user's palm 141, in their entirety, when the glove is worn.

The wrist portion is expansible so as to hold more securely to the user's wrist. Therefore the embodiment also has an expandable opening means at a wrist end 102 adapted to receive the user's hand. The expandable opening means comprises an elastic material along the wrist portion, such as an elastomeric band 103 fixed around throughout the wrist. In addition, the glove further comprises a strap means 147 at the open end of the glove body dorsal portion for fastening the glove body secure about the wrist area, critical in sports activities where the user's hand moves very rapidly such as in golf or football. The strap means may be unitary with the glove body and may include VELCRO fasteners 148, 149, buttons, and the like or other suitable closures thereon. The strap means allows the user to ensure a tight fit around the user's hand so that it will not disengage from the user's hand during high velocity sport movements such as swinging a driving wood golf club or throwing a Hail Mary football pass. The strap means also allows the user to quickly engage and disengage the glove, important aspects during active sports play such as in golf and in football. The wrist portion further comprises a slit 160. The slit allows the user to quickly take off or put on the glove, and doing so very easily.

Combining the slit and a strap means is especially valuable to users who play a sport that requires the constant removal of the glove, such as in football—where players generally take off their gloves during a change of possession, and in golf—where virtually all players take off their glove when preparing to putt a golf ball. The strap means is adapted to allow the user to mechanically stretch the strap means across the slit and fasten the glove to the user's hand.

This embodiment further provides unique and critical features on and around the distal terminal edge 118 of the partial forefinger digital segment that is adapted to expose the distal phalanx of the user's forefinger when the glove is worn. Specifically, for example, the distal terminal edge is reinforced by stitching 119. Stitching the forefinger stall along or around the opening is very important because the opening would otherwise easily tear, destroying the finger segment and therefore the glove making the glove inoperable. Therefore the stitching is adapted to encircle the entire distal terminal edge in order to be most effective at preventing tearing.

The forefinger segment distal terminal edge 118 is further sealed 152. When cutting certain materials such as synthetic materials including synthetic leather and flexible plastics it is virtually impossible to keep the edges from fraying and splitting, or from allowing atmospheric moisture to enter into the material through the formed edges, thereby eroding and destroying the glove material. Therefore it is essential that the entire distal terminal edge 118 of the forefinger digital segment be permanently sealed 152, preferably by hot knife sealing 152. The industrial hot knife is preferably used to melt the fabric edges of the terminal edge such that the terminal edge is entirely sealed thereby preventing fraying, fabric splitting, and atmospheric moisture from entering into the glove body through the terminal edges. If any portion of the terminal edge is not sealed, in other words if there are portions along the terminal edge which are not completely sealed, these portions along the distal terminal edge will fray or split eroding the integrity of the glove structure and its valuable and unique benefits to the user. Hot knife sealing also creates a smooth finish along the entire distal terminal edge allowing for easier glove application principally be allowing the user's forefinger to smoothly engaging and disengaging the partial forefinger digital segment. Hot knife sealing can only be performed on certain materials such as flexible plastics or synthetic materials such as synthetic leather and polyester otherwise the material will burn and cause harm. Cotton material and genuine leather for example will burn and therefore hot knife sealing cannot be performed on that type of material.

Additionally, embodiments may offer a liner is fixed to the interior of the glove using methods known in the art, such as stitching. The liner 161 may be integrally formed on the glove. For example, the liner (or sleeve) could be attached to the glove by standard methods, such as by conventional stitching about the perimeter of the dorsal segment, the palmar segment or both.

The lining material (or sleeve) may be comprised of standard lining materials, such as a smooth, flexible knitted fabric. The liner may also comprise of flexible and elastomeric material such as spandex or LYCRA. Other possible materials include a knit of polyester or simply the same material forming the glove. A soft cellular plastic could also be preferred. Additionally, the liner may provide added features to offer warmth and comfort such as by comprising of a fleece material, for example, especially useful when competing in harsher conditions or during extended practices on the golf range, for example. It will be apparent to one of ordinary skill in the art that many other implementations of liners are possible.

Embodiments may also preferably comprise an aperture 140 along the middle finger digital segment such that it exposes at least a portion of the middle finger's proximal phalanx. This embodiment shows an aperture that resides along the middle finger digital segment such that it exposes the user's proximal phalanx, thereby defining its terminal edges. It is critical that the aperture is large enough such that the skin of the middle finger may touch or be touched by the pinkie finger of the dominant hand, for example, while gripping a golf club. As shown, the aperture resides on the dorsal portion of said middle finger proximal phalanx segment. The materials forming the illustrated embodiment may comprise those discussed in reference to the present invention. Likewise, any previously discussed methods of construction may be applied to this embodiment.

FIG. 10 is a drawing of a typical interlocking grip using prior art. As can be seen, the dominant hand's pinkie finger interlocks with the user's weak hand forefinger. The golfer is using a conventional golf glove on the weak hand. The pinkie is clearly exposed to moisture by the micro-recesses provided on the proximal phalanges of the middle finger and forefinger.

I claim:

1. A glove comprising: a glove body comprising a palmar portion material, a dorsal portion material and a distal lateral edge, wherein the palmar portion material and the dorsal portion material meet at the distal lateral edge; and a plurality of digital segments projecting from the distal lateral edge of the body, the plurality of digital segments including a first digital segment designed to cover a middle finger; and wherein said plurality of digital segments further comprises a second digital segment, a third digital segment, a fourth digital segment and a fifth digital segment;

wherein said second digital segment is adapted to cover and enclose an entire ring finger, and wherein said third digital segment is adapted to cover and enclose an entire pinkie finger, and wherein said fourth digital segment is adapted to cover and enclose an entire thumb when the glove is worn; and wherein said fifth digital segment is adapted to cover up to but not more than a proximal phalanx of the forefinger of the user's finger when the glove is worn, and wherein said fifth digital segment has a distal terminal edge;

wherein said fifth digital segment is adapted to expose an entire middle phalanx and an entire distal phalanx of the user's forefinger when the glove is worn; and, wherein said glove body dorsal portion further comprises a strap means that is adapted for fastening the glove body securely about a wrist of the user's hand when the glove is worn;

the strap means comprises of two pads of cohesive-adhesive material along the glove body dorsal portion; and, wherein said glove body dorsal portion further comprises of a slit that is adapted to allow the user to engage and disengage the glove;

wherein the strap means is positioned along the glove body dorsal portion such that the user can manually extend the strap means across the slit; and wherein said glove body further comprises an elastomeric band affixed around a wrist portion of said glove body; and, wherein said glove body palmar portion material adapted to cover a palm of the hand including all five metacarpophalangeal joints of the user's hand when the glove is worn.

2. The glove of 1, wherein said strap means further comprises of a flap and capture mechanism that is adapted for fastening the glove body securely about the wrist of the user's hand when the glove is worn.

3. The glove of 1, wherein said strap means along the glove body dorsal portion comprises a hook and loop fastening interface for releasably securing and releasing a strap by the user;

wherein said strap is affixed on the glove body dorsal portion, the glove body palmar portion is thereby free of a strap and hook and loop fastening interface.

4. The glove of 1, wherein said strap means comprises of a strap and hook and loop fastening interface for releasably securing and releasing the strap by the user; and wherein said strap is affixed to the dorsal portion of the glove body.

5. The glove of claim 1, wherein said glove further comprises a grip enhancing means along the glove palmar portion; wherein said grip enhancing means is adapted to provide a higher coefficient of friction than a surrounding palmar portion, thereby increasing the user's grip capabilities when the glove is worn.

6. The glove of claim 1, wherein said forefinger segment distal terminal edge is stitched to reinforce said distal terminal edge.

7. The glove of claim 1, wherein said distal terminal edge is stitched to prevent said distal terminal edge from tearing; and wherein said glove body first digital segment is adapted to cover and enclose the entire middle finger of the user's hand when the glove is worn.

* * * * *